United States Patent [19]

Inanaga et al.

[11] Patent Number: 5,062,140

[45] Date of Patent: Oct. 29, 1991

[54] INDUCTION SPEAKER

[75] Inventors: Kiyofumi Inanaga; Hiroyuki Sogawa; Shiro Tsukamoto, all of Kanagawa, Japan

[73] Assignee: Sony Corporation, Tokyo, Japan

[21] Appl. No.: 340,034

[22] Filed: Apr. 18, 1989

[30] Foreign Application Priority Data

| | | | |
|---|---|---|---|
| Apr. 27, 1988 | [JP] | Japan | 63-104596 |
| May 17, 1988 | [JP] | Japan | 63-120233 |
| May 23, 1988 | [JP] | Japan | 63-125387 |

[51] Int. Cl.[5] ..... H04R 25/00

[52] U.S. Cl. ..... 381/199; 381/201; 381/202

[58] Field of Search ..... 381/199, 200, 201, 202, 381/194, 195, 192

[56] References Cited

U.S. PATENT DOCUMENTS

| | | | |
|---|---|---|---|
| 1,570,287 | 1/1926 | Sell | 381/202 |
| 2,003,901 | 6/1935 | Smith et al. | 381/202 |
| 3,586,792 | 6/1971 | Michael | 381/194 |
| 3,838,216 | 9/1974 | Watkins | 381/195 |
| 4,160,133 | 7/1979 | Wiik | 381/194 |
| 4,661,973 | 4/1987 | Takahashi | 381/199 |
| 4,709,392 | 11/1987 | Kato et al. | 381/193 |

FOREIGN PATENT DOCUMENTS

| | | |
|---|---|---|
| 50-105438 | 8/1975 | Japan . |
| 50-105439 | 8/1975 | Japan . |
| 56-8997 | 1/1981 | Japan . |
| 56-27039 | 6/1981 | Japan . |
| 57-28497 | 2/1982 | Japan . |
| 59-32292 | 2/1984 | Japan . |
| WO8102501 | 9/1981 | PCT Int'l Appl. . |
| 2126044 | 3/1984 | United Kingdom . |

*Primary Examiner*—James L. Dwyer
*Assistant Examiner*—Jason Chan
*Attorney, Agent, or Firm*—Alvin Sinderbrand; William S. Frommer

[57] ABSTRACT

In a speaker which comprises a diaphragm having a vibrating portion and an annular conductive portion, a current feeding coil facing the conductive portion with a predetermined gap therebetween, and a magnetic circuit including a top plate, a magnet and a yoke plate to which the current feeding coil is attached; the diaphragm is formed so that an electrical resistance of its conductive portion is lower than an electrical resistance of its vibrating portion.

26 Claims, 19 Drawing Sheets

INDUCTION SPEAKER

BACKGROUND OF THE INVENTION

1. Field of the Invention

The present invention relates to a speaker and, more particularly, to an induction type speaker.

2. Description of the Prior Art

In a conventional dynamic type speaker, by allowing an audio signal current to flow through a voice coil in a DC magnetic field, a driving force is obtained. The audio signal current is ordinarily supplied from the outside to the voice coil through lead wires fixed to a paper cone diaphragm.

However, a conventional dynamic type speaker has lead wires, which presents a drawback in that the lead wires can be easily cut due to elastic fatigue or the like caused by the reciprocating motion of the diaphragm. Even in the case where the lead wires are not cut, there is a drawback in that since the linearity in the reciprocating motion of the diaphragm is obstructed by the spring force of the lead wires, a sound distortion can easily occur and the lead wires themselves resonate producing an abnormal sound. Furthermore, since the lead wires must be led out from a narrow gap of the speaker and must be positioned, adhered, and fixed properly, the assembly is troublesome.

An induction type speaker from which lead wires are eliminated and a driving coil is arranged near a voice coil wound around a voice coil bobbin has been disclosed in the Official Gazette of Japanese Patent Application Publication No. 27039/1981. An audio signal current is supplied to the driving coil and the audio signal is supplied from the driving coil to the voice coil by magnetic induction. That is, when an AC signal flows from an electric power amplifier with an audio frequency to the driving coil, an AC magnetic flux corresponding to the input waveform is generated. The AC magnetic flux closely interlinks the voice coil located at a very close distance. Since the voice coil itself is short-circuited, a short-circuit current flows through the voice coil by the AC magnetic flux.

Since the voice coil is located in the magnetic field which is produced by a pole piece and the peripheral magnetic poles, a force which is proportional to the product of the intensity of the magnetic field and the short-circuit current acts on the voice coil. The force is transferred from the voice coil to the voice coil bobbin and vibrates a cone-shaped diaphragm thereby generating sound from the diaphragm as in the ordinary speaker.

Although various drawbacks due to lead wires are eliminated in the above disclosed technique, the following other problems occur.

Since the voice coil is generally fixed to the voice coil bobbin by an adhesive agent, it is difficult transfer the driving force generated in the voice coil to the diaphragm.

In addition, there is a drawback in that it is difficult to satisfactorily radiate the heat generated by the short-circuit current in the voice coil.

In order to improve the sensitivity of the speaker, it is required to narrow the magnetic gap between the coil bobbin and the driving coil, and to wind the voice coil a number of times in the gap. Therefore, the diameter of metal wire used for the voice coil becomes smaller with a corresponding decrease in the heat capacity of the metal wire. Thus, in addition to the problems of the heat radiation as mentioned above, there is the disadvantage that the heat generation could cause a break in the smaller diameter voice coil wire thereby limiting the current capacity.

Further, there is a whereby continuous repeated exposure to heat causes the paper voice coil bobbin to carbonize.

Therefore, an induction type speaker from which a voice coil is eliminated has been proposed in the Official Gazette of Japanese Utility Model Registration Application Laid-open No. 105438/1975.

In such an induction type speaker 1, as shown in FIG. 1, a diaphragm 4, having an annular conductive portion 3, is supported in an annular magnetic gap portion 2 by a damper 10 so as to freely vibrate. A current feeding coil 5, which is mechanically separated from the diaphragm 4 and electrically coupled with the conductive portion 3 by the mutual inductive operation, is arranged on the side of a magnetic circuit.

The magnetic gap portion 2 is formed annularly between a top plate 7, which sandwiches a magnet 6 such as a ferrite or similar magnet and which constitutes a magnetic circuit, and a center pole 9 of a yoke plate 8. Damper 10, which supports the diaphragm 4 so as to freely vibrate, is arranged on top plate 7.

The diaphragm 4 has a dome shape and annular conductive portion 3 in its opening edge portion. The entire diaphragm 4 is a thin plate-shaped good conductor, constructed from aluminum, beryllium, magnesium, or the like. Further, as mentioned above, since the current feeding coil 5 is to be mechanically separated from the diaphragm 4 and electrically coupled with the annular conductive portion 3 by the mutual inductive operation, the current feeding coil 5 is arranged so as to face the annular conductive portion 3 in either a position of an outer or inner periphery or an opening edge portion of the conductive portion 3. In this case, the current feeding coil 5 is fixed to an outer periphery of the edge portion of the center pole 9. The speaker 1 constructed as mentioned above operates as follows:

First, when an AC signal corresponding to an audio signal or the like is supplied to the current feeding coil 5, an induction current of the same frequency is induced in the annular conductive portion 3 of the diaphragm 4 by the mutual inductive phenomenon due to the interlinked magnetic flux generated by the current feeding coil 5. The induction current in the conductive portion 3 acts on the DC magnetic field from the magnetic circuit of magnetic gap portion 2 so as to drive diaphragm 4 and generated a sound wave.

In the above disclosed technique proposed in the Official Gazette of Japanese Utility Model Registration Application Laid-open No. 105438/1975, the lead wires and voice coil are eliminated, so that the various drawbacks due to lead wires, voice coil, and the like are eliminated.

However, the above diaphragm must be ordinarily formed from a metal since it is necessary to generate the induction current in the conductive portion part of the diaphragm.

When the diaphragm is formed from a metal, it becomes heavy, so that the response sensitivity of the speaker is reduced.

In addition to reduction of the response sensitivity, with the diaphragm made of metal the mechanical loss is small and the diaphragm is relatively heavy. This results in a frequency characteristic of the speaker which is not flat, sharp resonance peaks appear as shown in FIG. 2. Further, upon reading resonance, it is difficult to brake or damp the diaphragm.

Therefore upon resonance, the sound quality deteriorates.

Furthermore, since the conductive portion of the diaphragm and the portions other than the conductive portion in the diaphragm are not insulated at all, there is a problem such that the induction current induced in the conductive portion leaks out of the conductive portion becoming a leakage current thereby reducing the induction current by the amount of the leakage current. The leakage current also reduces the force to drive the diaphragm, so that the response sensitivity of the speaker deteriorates.

In an induction type speaker, a high-pass filter is equivalently constructed on the input side. Therefore, limitation in the reproducing of low frequency sounds is presented such that low frequencies cannot be reproduced.

The diaphragm 4 reciprocates in the directions indicated by arrows U-D in FIG. 3 in accordance with the induction current.

In FIG. 3, assuming that a range of the DC magnetic field having a uniform magnetic flux distribution (hereafter, the uniform magnetic field range) is set to L1 and a length of conductive portion 3 is set to L2 wherein, the uniform magnetic field range L1 and length L2 are substantially equalized.

Now, consider the case where the diaphragm 4 moves by only a length l in the direction indicated by the arrow U so that, an edge portion 3*a* of the conductive portion 3 reaches a point P1 in the uniform magnetiac field range L1. In such a case, in only the portion of conductive portion 3 corresponding to length (L1−l) lies within the uniform magnetic field range L1. The other portions [that is, the length corresponding to L2−(L1−l)] of the conductive portion 3 move outside of the uniform magnetic field range L1.

When the conductive portion 3 is out of the uniform magnetic field range L1, the magnetic flux density greatly decreases and if the induction current remains constant, the driving force to the diaphragm 4 also greatly decreases. That is, the amplitude of the diaphragm 4 response increases in accordance with the induction current. When the conductive portion 3 is deviated greatly from inside the uniform magnetic field range L1, the driving force is reduced whereby, the amplitude of diaphragm 4 does not accurately respond to a change in audio vibration, so that the linearity is lost and a distortion occurs.

OBJECTS AND SUMMARY OF THE INVENTION

Accordingly, it is an object of the present invention to provide a speaker which can transfer the vibration of the voice coil to a diaphragm without mechanical loss and can improve the sound quality.

Another object of the invention is to provide a speaker which can prevent leakage current flowing through the diaphragm.

Still another object of the invention is to provide a speaker which can reduce the weight of diaphragm.

A further object of the invention is to provide an induction type speaker having good linearity so as to accurately respond to an audio signal.

In accordance with an aspect of the invention a speaker comprises: a diaphragm consisting of a vibrating portion and an annular conductive portion; a current feeding coil which is arranged so as to face the conductive portion with a predetermined gap therebetween; and a magnetic circuit to which the current feeding coil is attached; with the diaphragm being formed so that the electrical resistance of the conductive portion is lower than the electrical resistance of the vibrating portion.

The above, and other, objects, features and advantages of the present invention will become readily apparent from the following detailed description thereof which is to be read in connection with the accompanying drawings.

DETAILED DESCRIPTION OF THE PREFERRED EMBODIMENTS

Embodiments of the present invention will be described hereinbelow with reference to the drawings.

Figure 4:
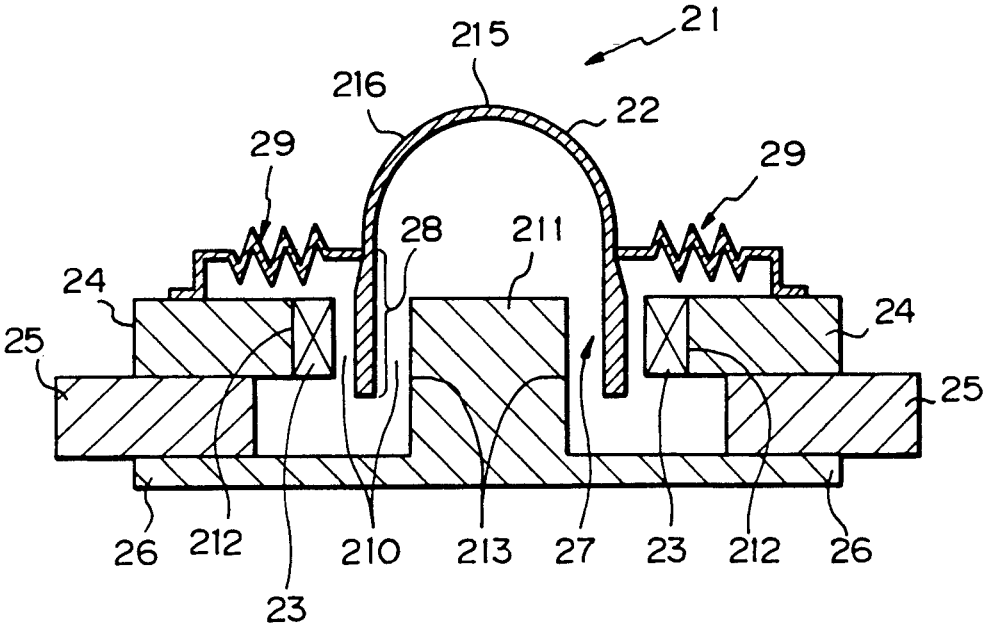
FIG. 4 is a cross sectional view showing the first embodiment of the present invention.

FIG. 4 shows the first embodiment according to the invention. In the construction shown in FIG. 4, a speaker 21 mainly comprises: a diaphragm 22; a damper 29; a current feeding coil 23 as a primary coil; a top plate 24; a magnet 25; a yoke plate 26; and a pole piece 211.

The diaphragm 22 is formed into a dome shape and comprises: a vibrating portion 215 which is thinly formed into a semi-spherical shape; and a secondary coil constituted by a conductive portion 28 which is thickly annulary formed at an opening edge portion 27. The whole diaphragm 22 is a good conductor constructed from metal such as aluminum, beryllium, magnesium, or the like. The diaphragm 22 is supported by the damper 29 so as to freely vibrate in a state in which the conductive portion 28 is located in a magnetic gap portion 210. The magnetic gap portion 210 is annularly formed between the top plate 24 and the pole piece 211 of the yoke plate 26.

The damper 29 has a spring characteristic and is annularly formed. The inner peripheral side of the damper 29 is connected to the periphery of the conductive portion 28 and the outer peripheral side is fixed onto the top plate 24.

The current feeding coil 23, acting as a primary coil, allows the annular conductive portion 28 to be electrically coupled by the mutual inductive operation and is arranged so as to face the conductive portion 28 with a predetermined gap. The current feeding coil 23 is further arranged so as to face either the outer peripheral corresponding position or inner peripheral corresponding position of the conductive portion 28. In order to face the outer periphery of the annular conductive portion 28, the current feeding coil 23 in the example shown in the diagram is fixed to one side edge surface 212 of the top plate 24. On the other hand, in the case of arranging the current feeding coil 23 to face the inner peripheral of the conductive portion 28, the coil 23 is fixed to the side of an outer periphery 213 of the pole piece 211. The current feeding coil 23 may be arranged at either the outer or inner peripheral corresponding positions of the conductive portion 28.

Instead of attaching the current feeding coil 23 to the top plate 24 by an adhesive agent as shown in FIG. 4, the current feeding coil 23 can be attached to the top plate 24 or pole piece 211 as shown in FIGS. 11 to 14. Thus the heat generated in the current feeding coil 23 can be dissipated to the top plate 24 and pole piece 211. Therefore, the problem of heat accumulation in the current feeding foil 23 due to the thermal resistance of the adhesive can be eliminated by attaching the current feeding coil 23 as described in FIGS. 11–14. The attaching structure of the current feeding coil will now be described briefly. The structures shown in FIGS. 11 to 14 can be applied to embodiments which will be described later.

Figure 11:
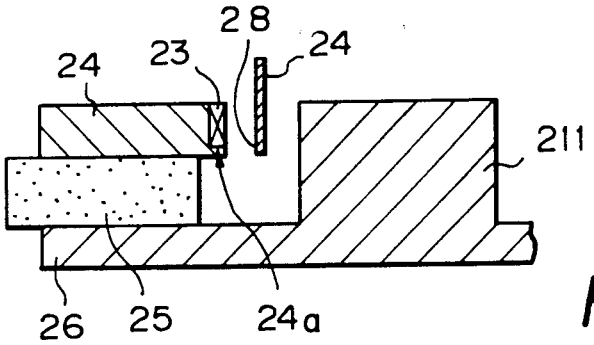
FIGS. 11 to 14 are cross sectional views of modifications to the structure required to attach a current feeding coil.

In an example shown in FIG. 11, a step portion 24*a* constitues the positioning means for the current feeding coil 23 and is formed on a side of an inner periphery of the top plate 24. The current feeding coil 23 is fixed to the step portion 24*a* by an adhesive agent. In this case, due to the step portion 24*a*, the height of the current feeding coil 23 can be always maintained at a constant value.

Since the positioning of the current feeding coil 23, as shown in FIG. 11, is made easier, productivity is improved. Furthermore, since an edge portion of the current feeding coil 23 is held by the step portion 24*a*, heat disslpation from the edge portion can be improved. Therefore, breakdowns due to vibration at high can be reduced.

Figure 12:
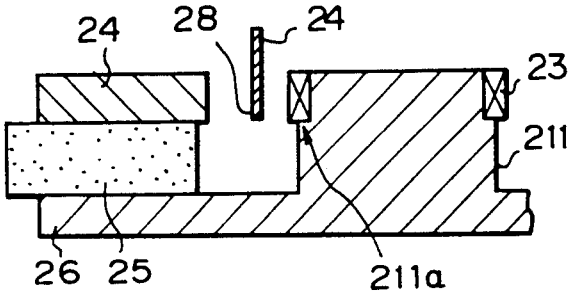

Next, in an example shown in FIG. 12, a step portion 211*a* constitutes positioning means of the current feeding coil 23 and is formed on a side of an outer periphery of the pole piece 211. The current feeding coil 23 is fixed to the step portion 211*a* by an adhesive agent. In this case, due to the step portion 211*a*, the height of the current feeding coil 23 can be always maintained at to a constant value.

As in FIG. 11, the positioning of the current feeding coil 23 as shown in FIG. 12 improves productivity and heat dissipation, and reduces breakdowns due to vibration and high temperature.

Figure 13:
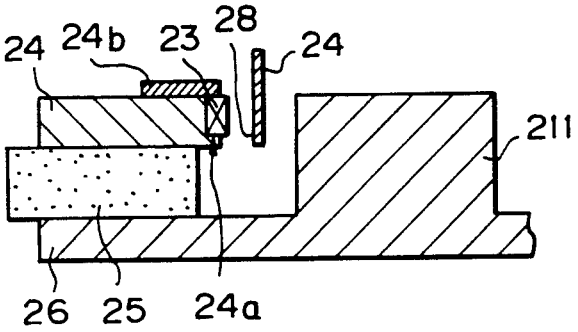
Figure 14:
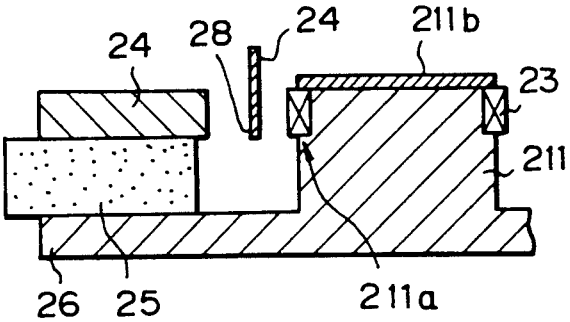

Next, FIG. 13 shows an example in which a pressing member 24*b* consisting of, a material having good thermal side opposite step portion 24*a* of top plate 24 by an adhesive agent. The remaining construction is similar to that shown in FIG. 11. FIG. 14 shows an example in which a pressing member 211*b* consisting of a material having good thermal conductivity is fixed to the side opposite step portion 211*a* by an adhesive agent. The remaining construction is similar to the example shown in FIG. 12.

The examples shown in FIGS. 13 and 14 produce similar results as those in FIGS. 11 and 12. Furthermore, since the opposite edge portions of the current feeding coil 23 are pressed to step portions 24*a* and 211*a* by the pressing members 24*b* and 211*b*, the heat dissipation from the edge portions can be improved. Therefore, breakdowns due to high input vibration and high temperature can be reduced.

A magnetic circuit is constructed by the top plate 24, magnet 25, yoke plate 26, and pole piece 211. As shown in FIG. 4, the magnet 25 is fixed to the outer peripheral portion of the yoke plate 26. The top plate 24 is fixed to the inner peripheral portion of magnet 25. A magnetic circuit is formed through the magnetic gap portion 210 along a path from the magnet 25 to the top plate 24, and a path from the magnet 25 to the yoke plate 26 and pole piece 211.

An example of the formation of the diaphragm 22 will now be described.

In the first embodiment, diaphragm 22 is formed, utilizing a cylindrical member 216 which is pressed to perform the integral contraction. In this case, the vibrating portion 215 is thinly formed to the necessary least thickness whereas the conductive portion 28 is formed thicker.

The conductive portion 28 is thickly formed which increases the cross sectional area of the conductive portion 28. The vibrating portion 215 is thinly formed which reduces the cross sectional area of the vibrating portion 215, thereby reducing the weight of the whole diaphragm 22. Furthermore, the resistance of the conductive portion 28 is reduced and the resistance of the vibrating portion 215 is increased.

The operation of the speaker 21 will now be described.

When an AC current operating as an audio signal flows through the current feeding coil 23, an AC magnetic flux corresponding to the input waveform is generated. Since the annular conductive portion 28 closely interlinks the AC magnetic flux, an induction current with the same frequency is induced in the conductive portion 28 by the mutual inductive phenomenon. Since the conductive portion 28 is located in the magnetic gap portion 210 a force, which is proportional to the product of the intensity of the DC magnetic field in the magnetic gap portion 210 and the induction current, acts on the conductive portion 28. That is, the induction current in the conductive portion 28 acts on the DC magnetic field in the magnetic gap portion 210 so as to drive the diaphragm 22 thereby generating a sound wave.

As mentioned above, since the conductive portion 28 is thickly formed and the vibrating portion 215 is thinly formed to the necessary minimum thickness, the weight of the whole diaphragm 22 can be reduced and the response sensitivity of the speaker 1 can be improved. Furthermore, with the cross sectional area of the conductive portion 28 increased and the cross sectional area of the vibrating portion 215 reduced the resistance of the conductive portion 28 decreases relative to the resistance of the vibrating portion 215. Therefore, a larger induction current flows through the conductive portion 28 thereby preventing the generation of a leakage current. Since the generation of the leakage current is prevented, the driving force of the diaphragm 22 can be increased so that the diaphragm 22 can be more sharply driven. Therefore, the response sensitivity of the speaker 21 can be improved.

FIG. 5 shows an example of the formation of diaphragm 22 in the second embodiment. It is an essential point in the formation of diaphragm 22 that only the thickness of the cylindrical member 216 in the range corresponding to the vibrating portion 215 is reduced by cutting.

Figure 5A:
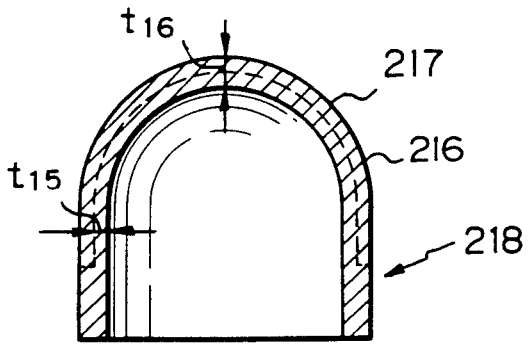
FIG. 5, consisting of A-B, is a cross sectional view of a diaphragm in the second embodiment of the present invention.
Figure 5B:
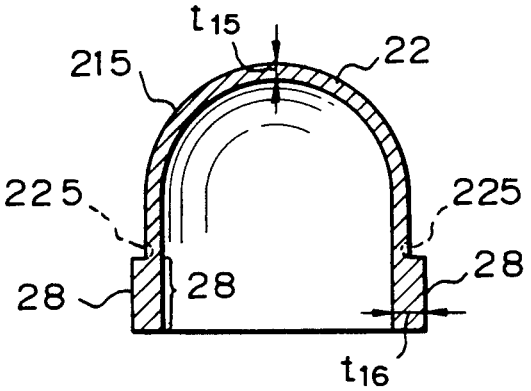

Outer peripheral surface 217 of the cylindrical member 216 having a thickness t16 as shown in FIG. 5A is cut to a minimum thickness of t15, leaving only a lower portion 218 uncut. Thus, the diaphragm 22 as shown in FIG. 5B is formed. That is, the diaphragm comprises: the thin vibrating portion 215 which is cut from the thickness t16 to t15; and the thick conductive portion 28 having the thickness of t16 in the non-cut state.

When a concave portion 225 as shown by a broken line in FIG. 5B is formed, the cross sectional area decreases, so that the resistance value between the conductive portion 28 and the vibrating portion 215 is increased. By providing such a concave portion 225, the cut-off frequency in the high band can be adjusted.

As mentioned above, although the second embodiment shows an example in which the diaphragm 22 is formed by cutting, other methods may be utilized such as sputtering, oxidizing treatment, or the like. If the diaphragm 22 is formed from aluminum, an oxidizing treatment, called alumite treatment is particularly effective. If black alumite treatment is selected, a good design can be obtained with improved heat radiating capability.

Since the other content is similar to the first embodiment, the overlapped description is omitted.

Figure 6:
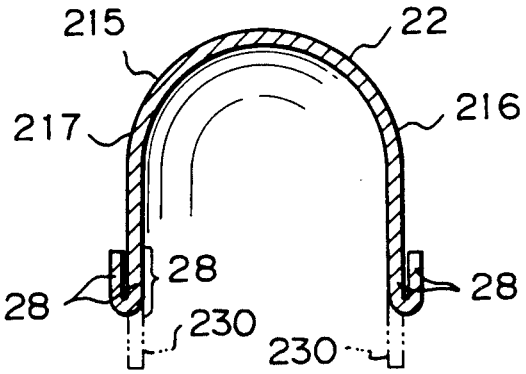
FIG. 6 is a cross sectional view of a diaphragm in the third embodiment of the present invention.

FIG. 6 shows an example of the formation of diaphragm 22 in the third embodiment. An explanation will now be made hereinbelow with reference to FIG. 6.

An opening edge portion 230 of the cylindrical member 216 formed so as to have the necessary minimum thickness is turned up forming the annular conductive portion 28, thereby forming diaphragm 22.

A pressing method or other suitable methods can be selected as a means for forming the diaphragm 22.

Since the remaining content is similar to that described in the first embodiment, its overlapped description is omitted.

FIG. 7 shows an example of the formation of diaphragm 22 in the fourth embodiment of the invention.

It is an essential point of formation of diaphragm 22 in the fourth embodiment that a thickness t8 of the conductive portion 28 is increased compared to thickness t16 of the cylindrical member 216 by plating.

Figure 7A:
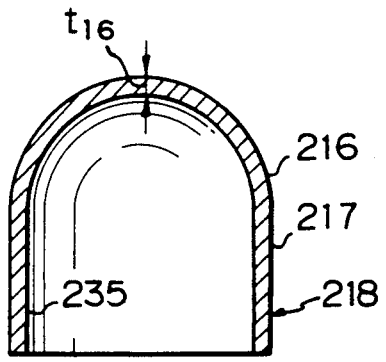
FIG. 7, consisting of A–D, is a cross sectional view of a diaphragm in the fourth embodiment of the present invention.
Figure 7B:
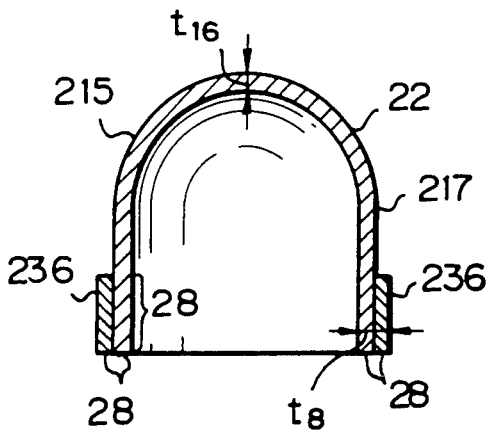

A metal such as gold, silver, or copper having good conductivity is plated only to the lower portion 218 of the outer peripheral surface 217 of the cylindrical member 216 [thickness t16], which is thinly formed to the minimum thickness as shown in FIG. 7A. Therefore as shown in FIG. 7B, the diaphragm 22 containing a plated portion 236, thickly formed toward the outer periphery, is constructed. Hence, the diaphragm 22 is constructed by the thin vibrating portion 215, which is not plated and has the thickness of t16, and the thick conductive portion 28 wherein the plated portion 236 is formed and has the thickness of t8.

Figure 7C:
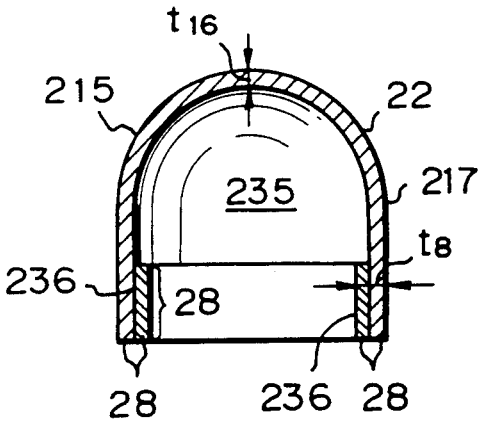

FIG. 7C shows a diaphragm in which the plated portion 236 is formed onto an inner peripheral surface 235 of the cylindrical member 216.

Figure 7D:
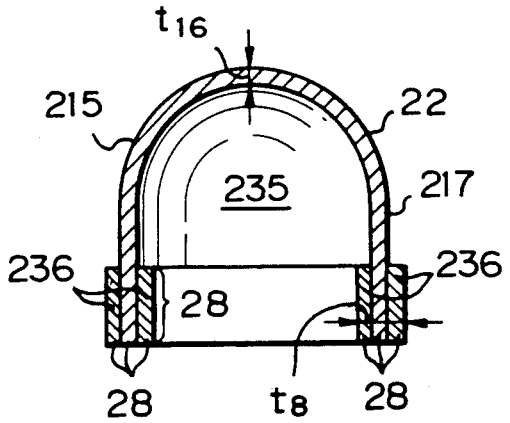

FIG. 7D shows a diaphragm in which the plated portion 236 is formed onto inner and outer peripheral surfaces 235 and 217. Although not described in detail, in those diaphragms the plated portion 236 is formed in a method similar to that used in the case of FIG. 7B, so that the desired function is derived.

In the fourth embodiment, the example of the plating process has been described. However, the invention is not limited to only a plating process but may be also executed by, for instance, sputtering.

Since the remaining content is similar to the first embodiment, its overlapped description is omitted.

Figure 8A:
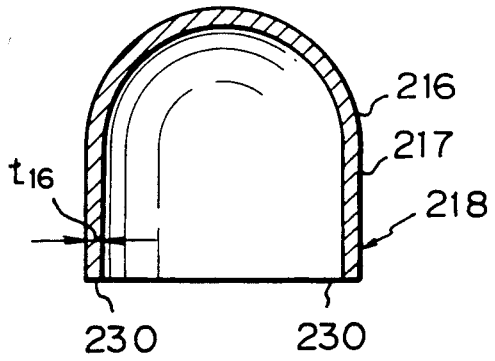
FIG. 8, consisting of A–C, is a cross sectional view for explaining the fifth embodiment of the present invention.
Figure 8B:
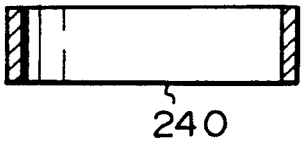

FIG. 8 shows an example of forming the diaphragm 22 in the fifth embodiment.

It is an essential point in formation of the diaphragm 22 in the fifth embodiment that the thickness of the conductive portion 28 is increased compared to than the thickness of t16 by fitting a conductive ring 240 over the opening edge portion 230 of the cylindrical member 216.

Figure 8C:
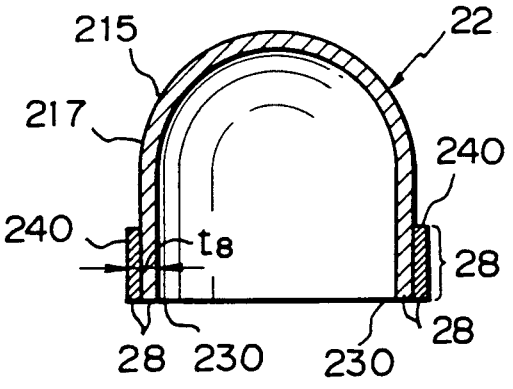

The conductive ring 240 is formed from a material having good conductivity and as shown in FIG. 8C is fitted over the outer peripheral surface 217 of the lower portion 218 of cylindrical member 216 [thickness t16] which is thinly formed to the minimum thickness. Thus, the diaphragm 22 as shown in FIG. 8C is formed.

Since the remaining content is similar to that described in the first embodiment, its overlapped description is omitted.

FIG. 9 shows an example of the formation of the diaphragm 22 in the sixth embodiment of the invention.

It is an essential point in the formation of the diaphragm 22 in the sixth embodiment that in the vibrating portion 215 of the diaphragm 22, which is thinly formed, a number of holes are formed in a portion 245 [hereinafter, referred to as a non-passing portion] through which the DC magnetic field does not pass at all.

Figure 10:
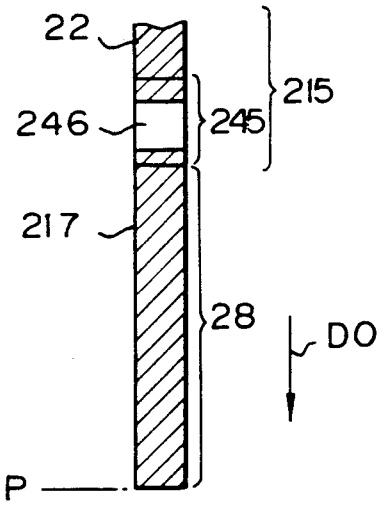
FIG. 10 is a partial enlarged cross sectional view taken along the line VII—VII in FIG. 9.

As shown in FIG. 10, the non-passing portion 245 is the lowest edge portion within the range where the DC magnetic field does not pass when the diaphragm 22 moves to the lowest [in the direction indicated by an arrow D0 in FIG. 10] position P.

Figure 9A:
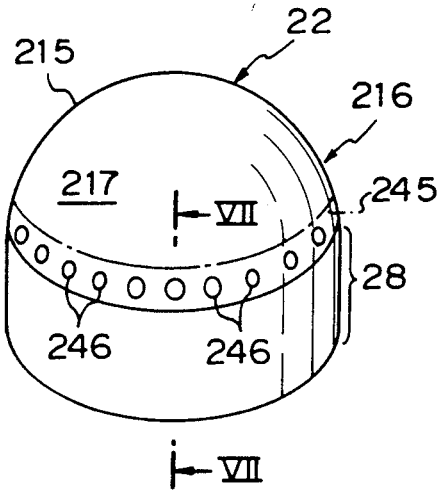
FIG. 9, consisting of A–C, is a perspective view for explaining the sixth embodiment of the present invention.
Figure 9B:
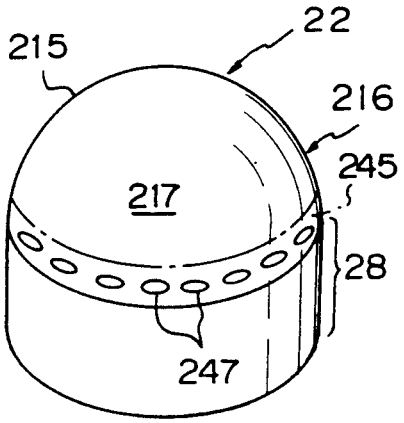
Figure 9C:
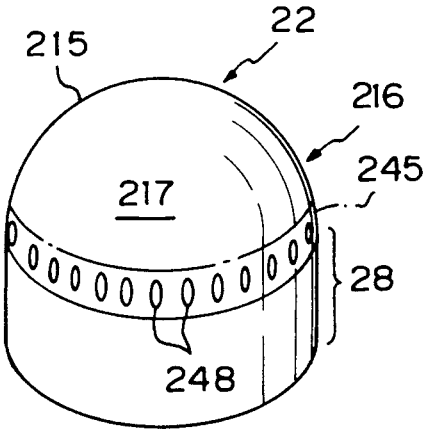

In the example shown in FIG. 9A, a number of circular holes 246 are formed in the non-passing portion 245. In the example shown in FIG. 9B, a number of laterally long holes 247 are formed in the non-passing portion 245. In the example shown in FIG. 9C, a number of vertically long holes 248 are formed in the non-passing portion 245.

By forming the holes 246, 247, or 248 in the non-passing portion 245 of the DC magnetic field, the weight of the diaphragm 22 is reduced. In the non-passing portion 245, the cross sectional area of the current flowing portion is reduced, thereby increasing the resistance and preventing the generation of a leakage current.

In addition, the high-band limit can be controlled in accordance with the formation of the holes 246, 247, or 248 thereby controlling the sound quality. For instance, with the laterally long holes 247 shown in FIG. 9B, it is difficult to generate high-band sound. However, with the vertically long holes 248 shown in FIG. 9C, the high-band sound can be easily generated.

Since the remaining content is similar to that described in the first embodiment, its overlapped description is omitted.

As mentioned above, in the first to sixth embodiments, the whole diaphragm 22 is formed from a good metal conductor wherein the thickness of the diaphragm 22 is partially changed so as to change the electrical resistance with a resulting reduction in the weight of the diaphragm itself. However, by forming the diaphragm itself from a non-conductive material and forming only the conductive portion with a good conductor which is fixed to the diaphragm, it is possible to reduce the weight of the diaphragm. The material of the diaphragm can be selected so as to derive results similar to those in the first to sixth embodiments. A construction utilizing this concept will now be described with reference to the drawings.

Figure 15:
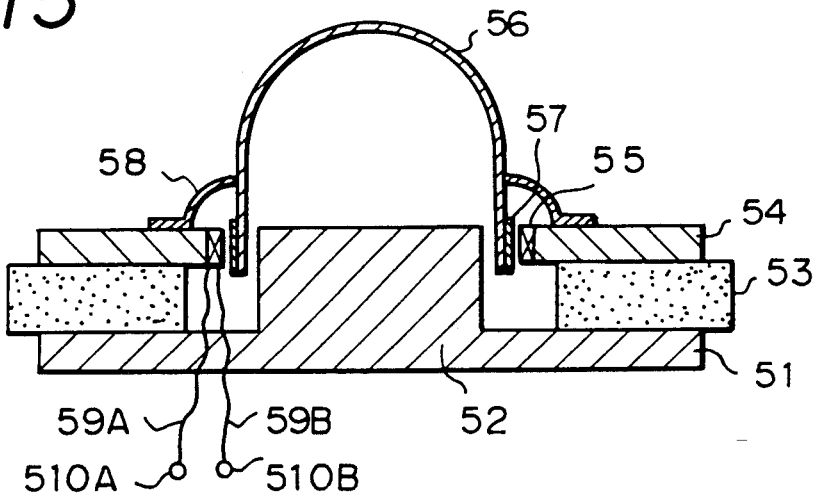
FIG. 15 is a cross sectional view of the seventh embodiment of the present invention.

FIG. 15 shows the seventh embodiment of the invention. In FIG. 15, a cylindrical pole piece 52 is formed at the center of a disk-shaped yoke plate 51. A ring-shaped magnet 53 is laminated and fixed onto the yoke plate 51. A ring-shaped top plate 54 is laminated and fixed onto the magnet 53. A magnetic circuit is constructed by the yoke plate 51, pole piece 52, magnet 53, and top plate 54. A current feeding coil 55 is wound around the inner periphery of the top plate 54. Lead wires 59A and 59B are led out from the current feeding coil 55.

Figure 16:
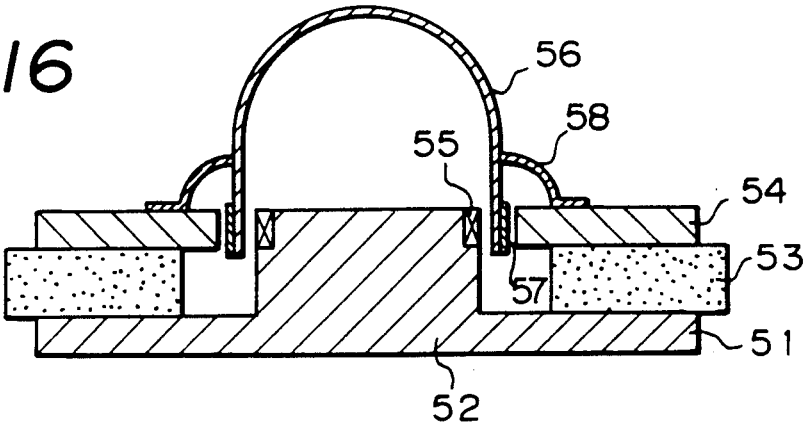
FIGS. 16 and 17 are cross sectional views showing modifications.
Figure 17:
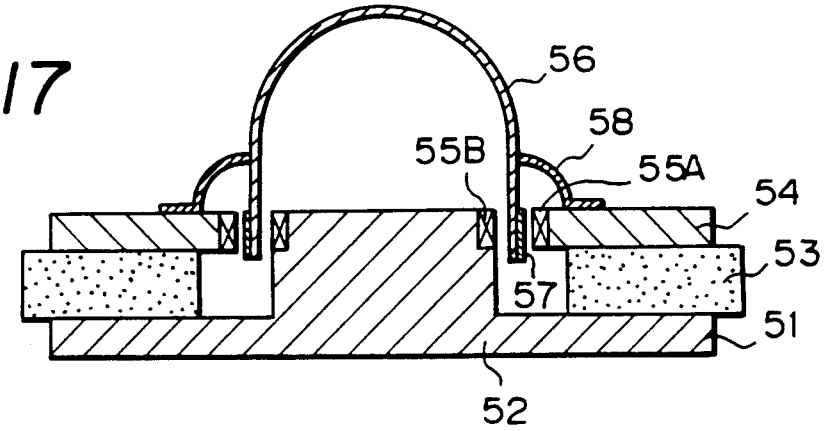

In place of winding the current feeding coil 55 around the inner periphery of the top plate 54, as shown in FIG. 15, the current feeding coil 55 can be also wound around the outer periphery of the pole piece 52 as shown in FIG. 16. As shown in FIG. 17, it is also possible to have a current feeding coil 55A wound around the inner periphery of the top plate 54, and a second current feeding coil 55B wound around the outer periphery of the pole piece 52.

The lead wires which are lead out from current feeding coil 55A and from current feeding coil 55B are connected serially or in parallel. Furthermore, it is also possible to use a member formed by winding a wire into a coil shape for the current feeding coil 55 and attach the current feeding coil 55 to the top plate 54 and pole piece 52.

A dome-shaped diaphragm 56 is formed from a non-conductive material, for instance, polymeric film, ceramics, cloth, paper, or the like. As will be explained in detail hereinlater, a conductive portion 57 is integrally attached to an opening edge portion of the diaphragm 56. A conductive metallic ring is fitted and attached to the outer periphery of the opening edge portion of the diaphragm 56, thereby forming the conductive portion 57. The conductive portion 57 operates as a voice coil having one or a few turns in an ordinary dynamic speaker.

A magnetic gap is formed in an interval where the outer periphery of the pole piece 52 faces the inner periphery of the top plate 54. The conductive portion 57, integrated with the diaphragm 56, is inserted into the magnetic gap. The diaphragm 56 is supported through a damper 58 so as to freely vibrate. The damper 58 may be also formed integrally with the diaphragm 56.

The speaker is driven by supplying an audio signal to terminals 510A and 510B of the lead wires 59A and 59B. That is, an AC signal operating as an audio signal is supplied from the terminals 510A and 510B to the current feeding coil 55 through the lead wires 59A and 59B. A magnetic flux is generated in the current feeding coil 55 by the AC signal. The magnetic flux interlinks the conductive portion 57 which is arranged so as to face the current feeding coil 55. Thus, an induction current flows through the conductive portion 57. Since the conductive portion 57 is located in the magnetic gap, which is the interval where the outer periphery of the pole piece 52 faces the inner periphery of the top plate 54, when the induction current flows through the conductive portion 57 a force is generated which moves the conductive portion 57. The diaphragm 56 integrated with the conductive portion 57 is thereby vibrated by this force.

In the seventh embodiment, the conductive portion 57 and diaphragm 56 are integrated so that the force generated in the conductive portion 57 is directly transferred to the diaphragm 56. Therefore, a situation wherein the coupling portion obstructs the vibration and deteriorates the sound quality, as in the conventional speaker in which the voice coil bobbin is fixed by, for instance, an adhesive agent, does not occur. Furthermore, since the diaphragm 56 is made of a non-conductive material the loss due to the leakage current is reduced compared to the case where the whole diaphragm 56 is constructed from a metal plate, is not caused.

As shown in FIGS. 18 to 21, the diaphragm 56 and conductive portion 57 can be integrated by mechanically coupling a ring-shaped conductor as the conductive portion 57 with the diaphragm 56.

Figure 18:
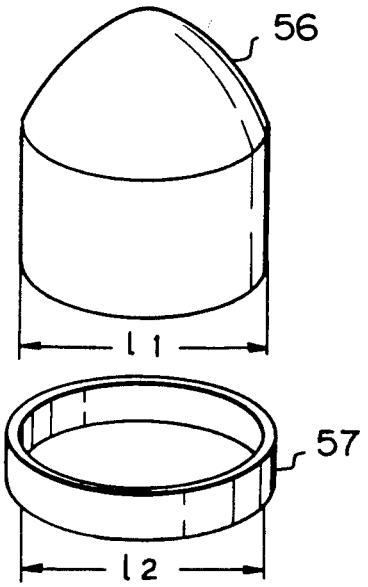
FIGS. 18 and 19 are perspective views which are used for explanation of examples in the case where a conductive portion is integrated by a mechanical coupling.
Figure 19:
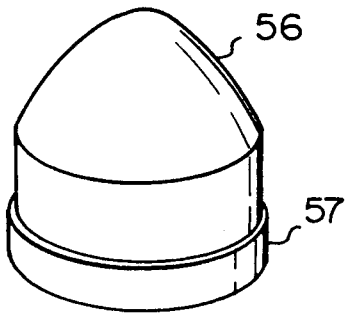
Figure 20:
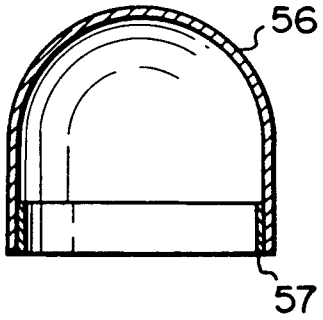
FIGS. 20 and 21 are cross sectional views which are used to explain other examples in the case where a conductive portion is integrated by a mechanical coupling.

That is, FIGS. 18 to 21 show the case where a ring-shaped metal is mechanically attached as the conductive portion 57 to the non-conductive material diaphragm 56. Diameter $l_1$ of the outer periphery of the opening edge portion of the diaphragm 56 is made to correspond to a diameter $l_2$ of the inner periphery of the ring-shaped conductive portion 57 as shown in FIG. 18. The ring-shaped metal is fitted as the conductive portion 57 to the opening edge portion of the outer periphery of the diaphragm 56 as shown in FIG. 19. For instance, the conductive portion 57 can be shrink fitted to the diaphragm 56 so as to fit tightly together FIG. 20 shows another example where a ring-shaped metal is fitted and mechanically attached as the conductive portion 57 to non-conductive material diaphragm 56. The diameter of the inner periphery of the opening edge portion of the diaphragm 56 is made of correspond to the diameter of the outer periphery of the conductive portion 57. The conductive portion 57 is fitted and attached to the opening edge portion of the inner periphery of the diaphragm 56.

Figure 21:
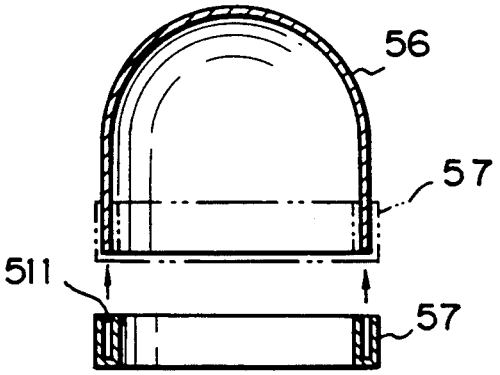

FIG. 21 shows still another example in which a ring-shaped metal is fitted and mechanically attached as the conductive portion 57 to the non-conductive material diaphragm 56. In such a case, a concave portion 511 having a U-shaped cross section is formed in the conductive portion 57. The opening edge portion of the diaphragm 56 is fitted and attached into the concave portion 511.

Figure 22:
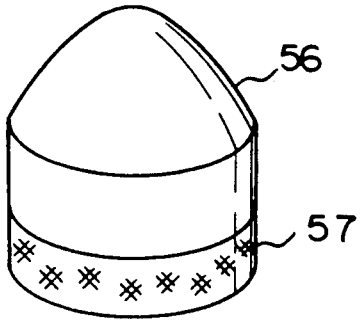
FIG. 22 is perspective view for use in explanation in the case of integrating a conductive portion by a thin film.

The diaphragm 56 and conductive portion 57 are not limited to such mechanical couplings. As shown in FIG. 22, a conductive thin film is formed and attached as the conductive portion 57 to the opening edge portion of the diaphragm 56. For such a case, the thin film can be formed and attached to the diaphragm in the following manner.

A conductive thin film can be formed as the conductive portion 57 to the opening edge portion of the diaphragm 56 by electroless plating. In this case, ceramics, polymeric film, or a resin molded member is used as the diaphragm 56.

Second, a conductive thin film can be formed as the conductive portion 57 to the opening edge portion of the diaphragm 56, wherein the diaphragm is constructed of ceramics, polymeric film, or a resin molded member, by a Chemical Vapor Deposition (CVD) method.

Furthermore, a conductive thin film can be formed as the conductive portion 57 to the opening edge portion of the diaphragm 56, wherein the diaphragm is constructed of ceramics, polymeric film, or a resin molded member, by evaporation deposition.

Furthermore, a conductive thin film can be formed as the conductive portion 57 to the opening edge portion of the diaphragm 56, wherein the diaphragm is constructed of ceramics, polymeric film, or a resin molded member, by sputtering.

In addition to such mechanical coupling or formation of the thin film, it is also possible to obtain conductivity in the opening edge portion of the diaphragm 56 by having the the diaphragm 56 and conductive portion 57 integrated; or to obtain conductivity in the opening edge portion of the conductive portion 57 by having the diaphragm 56 and conductive portion 57 integrated.

For instance, when a polymeric film is used as the diaphragm 56 and carbon or metal powder is mixed into the opening edge portion of the diaphragm 56, conductivity can be provided to the opening edge portion of the diaphragm 56 into which the carbon or metal powder was mixed. Thus, the conductive portion 57 is the portion having the conductivity.

Furthermore, for instance, when polyacetylene is used for the diaphragm 56 and iodine is doped into the opening edge portion of the diaphragm 56, conductivity is provided to the opening edge portion of the diaphragm 56. Thus, the conductive portion 57 is the portion having the conductivity.

Furthermore, in the case where the conductive portion 57 is formed by electroless plating or a thin film is formed by the CVD method, evaporation deposition, or sputtering to form the conductive portion 57, the conductive portion 57 may be also formed not only to the outer periphery of the opening edge portion of the diaphragm 56, but also to the inner periphery of the opening edge portion of the diaphragm 56 or to the outer and inner peripheries of the opening edge portion of the diaphragm 56.

Figure 23:
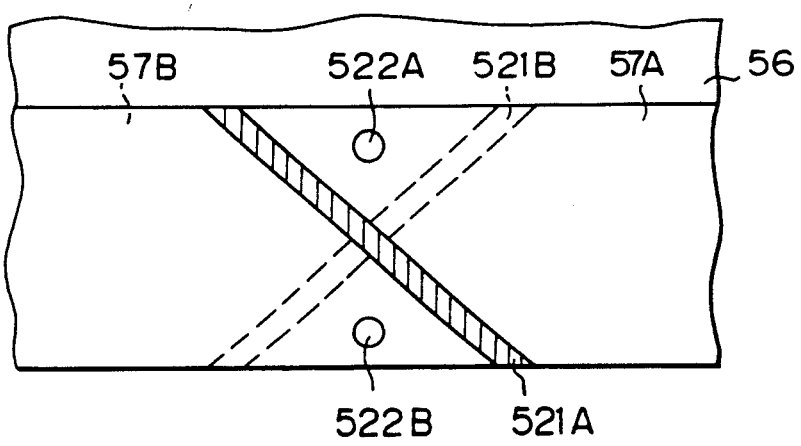
FIG. 23 is a plan view for use in explanation of the conductive portion.

In the case of forming the conductive portion 57 to the outer and inner peripheries of the opening edge portion of the diaphragm 56, the conductive portion 57 can be formed as a voice coil having two turns. That is, as shown in FIG. 23, a notched portion 521A is obliquely formed in a conductive portion 57A which is on the outer periphery of the diaphragm 56 and a notched portion 521B is obliquely formed in a conductive portion 57B which is on the inner periphery of the diaphragm 56. Through holes 522A and 522B are formed at positions near the edges of the conductive portions 57A and 57B. Conductors are supplied through holes 522A and 522B. Therefore, the edge of the conductive portion 57A on the front side and the edge of the conductive portion 57B on the back side are electrically connected via the through holes 522A and 522B, thereby obtaining two turns in conductive portions 57A and 57B.

The impedance of the speaker is determined by the numbers of turns of the current feeding coil 55 and the conductive portion 57. If two turns can be obtained by the conductive portions 57A and 57B as mentioned above, the impedance can be easily adjusted wherein the degree of freedom of the frequency characteristic adjustment is improved.

Furthermore, a coil with a plurality of turns may also be formed for the conductive portion 57A on the front side and the conductive portion 57B on the back side. Or, coils of a plurality of turns may be also formed for the conductive portion 57A on the front side and the conductive portion 57B on the back side. Coils with a plurality of turns, formed for the conductive portion 57A on the front side or the conductive portion 57B on the back side, may have the edge portions of the coils electrically connected.

Figure 1:
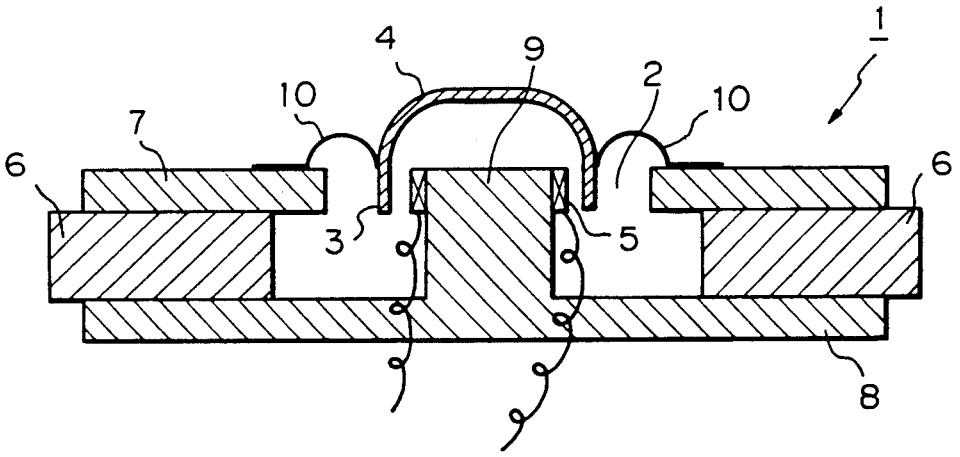
Fig. 1 (PRIOR ART)
FIG. 1 is a cross sectional view showing a conventional induction type speaker according to the prior art.
Figure 2:
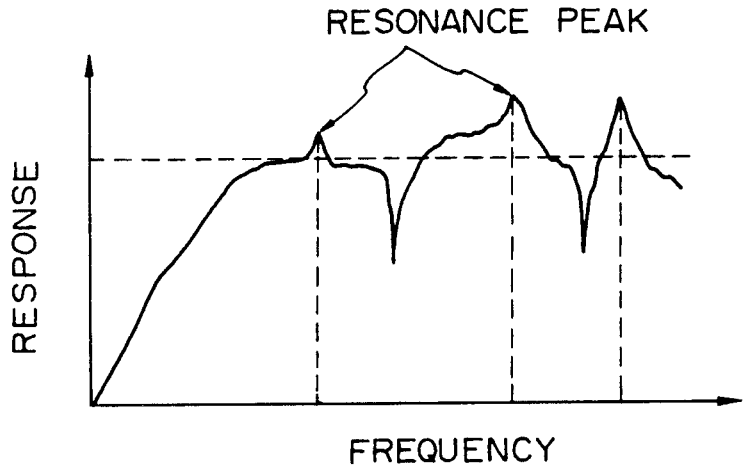
Fig. 2 (PRIOR ART)
FIG. 2 is an example of the frequency characteristic of a conventional induction type speaker according to the prior art.
Figure 3:
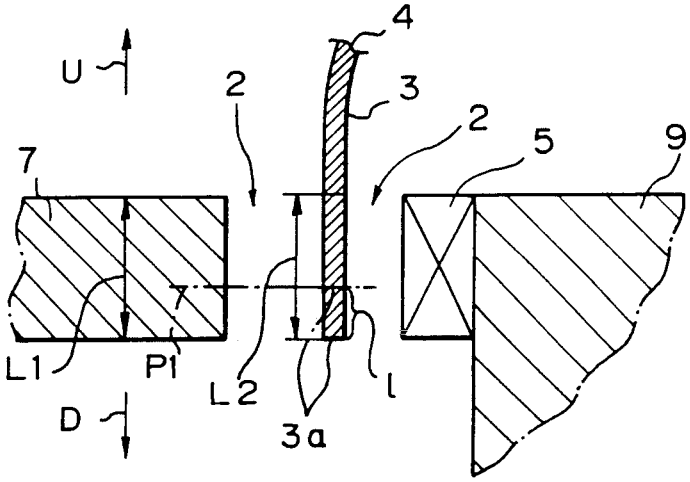
Fig. 3 (PRIOR ART)
FIG. 3 is a partial enlarged cross sectional view showing a main part of the conventional induction type speaker shown in FIG. 1 according to the prior art.

There is a possibility that the above-mentioned problems shown in FIG. 3 can not be solved completely by simply facing the conductive portion and the current feeding coil towards each other. Measures which can solve the above problems completely will now be explained with reference to the drawings.

Figure 24:
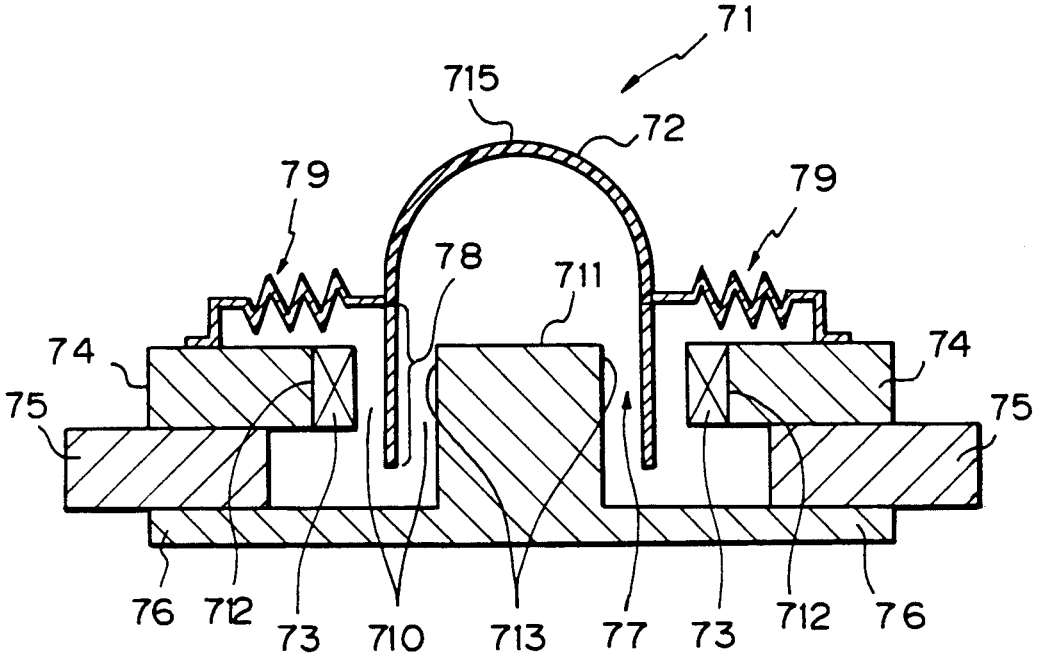
FIG. 24 is a cross sectional view showing the eighth embodiment of the present invention.

FIG. 24 shows the eighth embodiment according to the invention. In the construction shown in FIG. 24, a speaker 71 mainly comprises: a diaphragm 72; a damper 79; a current feeding coil 73; a top plate 74; a magnet 75; a yoke plate 76; and a pole piece 711.

The dome-shaped diaphragm 72 comprises a viabrating portion 715, which is formed in a semi-spherical shape, and a conductive portion 78, which is annularly formed in an opening edge portion 77. The diaphragm 72 is supported by the damper 79 so as to vibrate freely in a state in which the conductive portion 78 is located in a magnetic gap portion 710.

Figure 25:
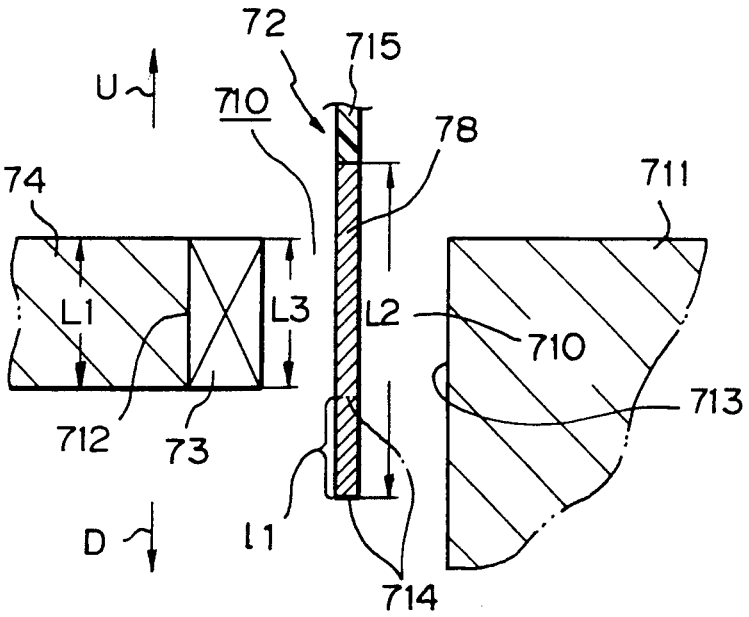
FIG. 25 is a partial enlarged cross sectional view showing the magnetic gap portion in FIG. 24.

As shown in FIGS. 24 and 25, the conductive portion 78 has a length L2 and a lower position than the magnetic gap portion 710. Even if the diaphragm 72 vibrates with large amplitudes in accordance with an induction current, the conductive portion 78 remains within the whole range L1 of the DC magnetic field which has a uniform magnetic flux distribution (hereinafter, identified as a uniform magnetic field range). That is, the length L2>uniform magnetic field range L1.

The foregoing vibrating portion 715 is formed from an insulative material such as a synthetic resin. The entire conductive portion 78 is formed from a good conductor such as aluminum, beryllium, magnesium, or the like. The entire diaphragm 72 may be also formed from a good conductor as in the foregoing embodiments.

The magnetic gap portion 710 is annularly formed between the top plate 74 and the pole piece 711 of the yoke plate 76.

The damper 79 has a spring characteristic and is annularly formed. The inner peripheral side of the damper 79 is connected to the periphery of the conductive portion 78 and the outer peripheral side is fixed onto the top plate 74.

The current feeding coil 73 allows the annular conductive portion 78 to be electrically coupled by the mutual inductive operation and is arranged so as to face the conductive portion 78 with a predetermined gap. In the current feeding coil 73, the winding method (winding pitch) and the length in the height direction are similar to those described for the conventional coil. As shown in FIG. 25, the length in the height direction (that is, in the directions indicated by arrows U-D in the diagram) is set to L3. The length L3 of the current feeding coil 73 is equal to the uniform magnetic field range L1 (that is, L3=L1), so that the length L2 of the conductive portion 78 is larger than the length L3 of the current feeding coil 73 (that is, L2>L3). The current feeding coil 73 can be arranged so as to face either the outer or inner peripheral corresponding position of the conductive portion 78. To have the current feeding coil 73 shown in the diagram face the outer periphery of the annular conductive portion 78, the coil 73 is fixed to one side edge surface 712 of the top plate 74. To have the current feeding coil 73 face the inner periphery of portion 78, the coil 73 is fixed to the side of the outer periphery 713 of the pole piece 711. The current feeding coil 73 may be also provided at both of the outer and inner peripheral corresponding positions of the conductive portion 78.

A magnetic circuit is constructed by the top plate 74, magnet 75, yoke plate 76, and pole piece 711 as shown in FIG. 24. That is, the magnet 75 is fixed to the outer peripheral portion of the yoke plate 76. The top plate 74 is fixed to the inner peripheral portion of magnet 75. The magnetic circuit is formed through the magnetic gap portion 710 along a path from the magnet 75 to the top plate 74 and a path from the magnet 75 to the yoke plate 76 and pole piece 711.

In the region from the top plate 74 to the pole piece 711 mentioned above, the DC magnetic field with uniform magnetic flux distribution is formed in the uniform magnetic field range L1. The length in the height direction (that is, the directions indicated by arrows U and D in FIG. 25) of the top plate 74 is set to the uniform magnetic field range L1 mentioned above.

The operation of the speaker 71 will now be described.

When an audio signal current is allowed to flow through the current feeding coil 73, an AC magnetic flux corresponding to the audio signal is generated. Since the annular conductive portion 78 closely interlinks the AC magnetic flux, an induction current corresponding to the audio signal is generated in the conductive portion 78 by the mutual inductive phenomenon. The induction current usually flows in the uniform magnetic field range L1 of the conductive portion 78 and seldom flows out of the uniform magnetic field range L1. Since the conductive portion 78 is located in the magnetic gap portion 710, a force, which is proportional to the product of the intensity of the DC magnetic field in the magnetic gap portion 710 and the magnitude of the induction current, acts on the conductive portion 78. Therefore, the induction current in the conductive portion 78 acts on the DC magnetic field in the magnetic gap portion 710, thereby driving the diaphragm 72 so as to generate a sound wave.

During operation of the speaker 71, the diaphragm 72 reciprocates in the directions indicated by arrows U-D in FIG. 25 in accordance with the induction current.

In FIG. 25, consider the case where the diaphragm 72 is moved by only a length l 1 in the direction of the arrow U. As shown, an edge portion 714 of the conductive portion 78 does not reach within the uniform magnetic field range L1.

In this case, since the conductive portion 78 exists within the entire uniform magnetic field range L1, an induction current which accurately corresponds to the audio signal is induced in the conductive portion 78.

The force, which is proportional to the product of the magnitude of the induction current and the intensity of the DC magnetic field, is applied to the conductive portion 78. Since the induction current accurately corresponds to the audio signal, as mentioned above, and since the intensity of the DC magnetic field does not change, then the driving force which drives diaphragm 72 corresponds to the audio signal. Therefore, the linearity between the audio signal current and the amplitude of the diaphragm is maintained and no distortion occurs.

In the current feeding coil 73 in the eighth embodiment the winding method and length are similar to those in the conventional coil, hence, the impedance does not increase and an acceptable frequency characteristic, which does not change even in the high-band, is obtained.

Compared to a conventional long voice coil type speaker wherein the length of the voice coil wound around the voice coil bobbin is larger than the length of the top plate 74 in the height direction, in the eight embodiment the induction current seldom flows through the conductive portion 78 when out of the uniform magnetic field range L1. Therefore, electric power is not wasted and efficiency is increased.

The construction of the eighth embodiment is suitable transmitting a speaker for low sound (woofer) wherein the amplitude of the diaphragm 72 is relatively large.

The ninth embodiment differs from the eighth embodiment in that a length L5 of a current feeding coil 720 is larger than a length L4 of a conductive portion 721.

Figure 26:
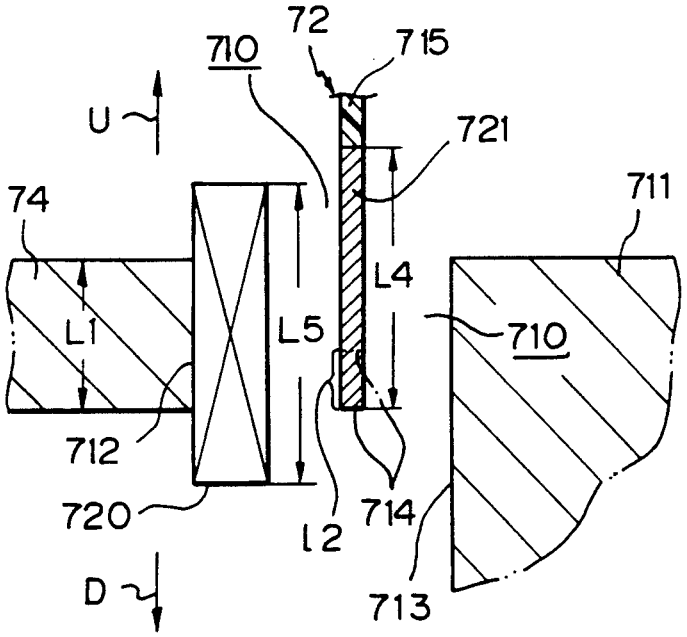
FIG. 26 is a partial enlarged cross sectional view similar to FIG. 25 and shows the ninth embodiment of the present invention.

In FIG. 26, since the length L5 is larger than the length L4, the current feeding coil 720 is longer than the conductive portion 721 in the height direction (that is, the directions indicated by arrows U-D in FIG. 26).

During operation of the speaker 71, the diaphragm 72 reciprocates in the directions of the arrows U-D in FIG. 26 in accordance with the induction current. In FIG. 26, consider the case where the diaphragm 72 is moved by only a length l 2 in the direction of the arrow U. Hence, the edge portion 714, of the conductive portion 721, enters the uniform magnetic field range L1 and the length of the overlap portion of the uniform magnetic field range L1 and the conductive portion 721 decreases.

The current feeding coil 720 is elongated and formed so as to have the length L5, so that the AC coupling of the current feeding coil 720 and the conductive portion 721 are held constant. Therefore, the induction current which is induced in the conductive portion 721 accurately corresponds to the audio signal.

Since the induction current accurately corresponds to the audio signal and the intensity of the DC magnetic field does not change, the driving force which drives diaphragm 72 corresponds to the audio signal. Consequently, the linearity between the audio signal and the amplitude of the diaphragm is maintained and no distortion occurs.

Since the length of conductive portion 721 is reduced, the weight of the diaphragm 72 in the ninth embodiment is also reduced.

The construction of the ninth embodiment is suitable for a speaker transmitting high sound (tweeter) wherein the amplitude of the diaphragm 72 is relatively small.

Since the remaining content is similar to that in the eighth embodiment, the same portions are designated by the same reference numerals and their overlapped discriptions are omitted.

Figure 27:
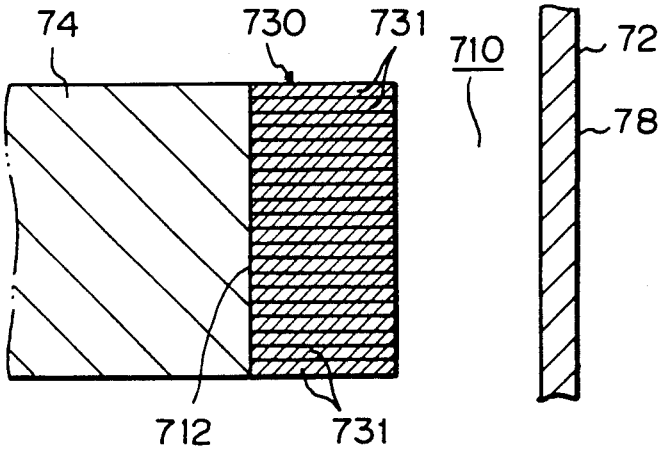
FIG. 27 is a partial enlarged cross sectional view showing modification 1 of the present invention.

FIG. 27 shows an example wherein current feeding coil 730 is constructed with flat type wire. That is, in place of the conducting wire having a circular cross section which is ordinarily used, a plurality of flat type wires 731 having rectangular cross sections are laminated and attached onto the inner periphery of the top plate 74.

There are various advantages in constructing the current feeding coil 730 from flat type wire 731.

First, the circular conducting wire has only point or line contact with the other conducting wire or top plate 74, while the flat type wire 731 has area contact. Therefore, the thermal conductivity is improved so that the heat generated in the current feeding coil 730 can be more easily dissipated.

Second, in spite of the fact that the magnetic gap portion 710 between the top plate 74 and the conductive portion 78 is a very narrow small space, there is a need to wind the conducting wire as many times as possible. In using circular conducting wire, which has point or line contact, gaps are inevitably caused between the conducting wire and the other conducting wires or top plate 74. However, since the flat type wire 731 has area contact, the foregoing gaps are not caused. Therefore, in the the same volume, the number of turns can be increased so that the magnetic gap portion 710 as a narrow small space is effectively used.

Figure 28:
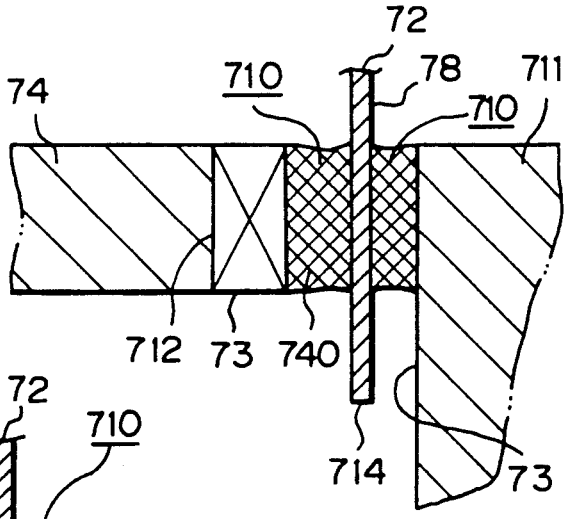
FIG. 28 is a partial enlarged cross sectional view showing modification 2.

FIG. 28 shows an example wherein a magnetic fluid 740 is arranged in the magnetic gap portion 710.

The magnetic fluid 740 may be formed in a gel state by mixing powder of a magnetic material such as iron into an oil.

By inserting the magnetic fluid 740 into the magnetic gap portion 710, various advantages are obtained.

First, when the magnetic fluid 740 exists in the magnetic gap portion 710, the magnetic gap portion 710 is equivalently narrowed, so that the magnetic flux density is raised thereby improving the efficiency.

Second, the heat generated in the conductive portion 78 of the diaphragm 72 is transferred through the magnetic fluid 740 into the magnetic circuit [that is, top plate 74, magnet 75, and yoke plate 76], so that a cooling effect is obtained.

Third, characteristics of the vibrating system including the resonant transmissibility (Q) can be more easily controlled due to the viscous properties of the fluid.

The contructions shown in FIGS. 27 and 28 can be applied to other embodiments similarly to the aforementioned constructions shown in FIGS. 11 to 14.

Figure 29:
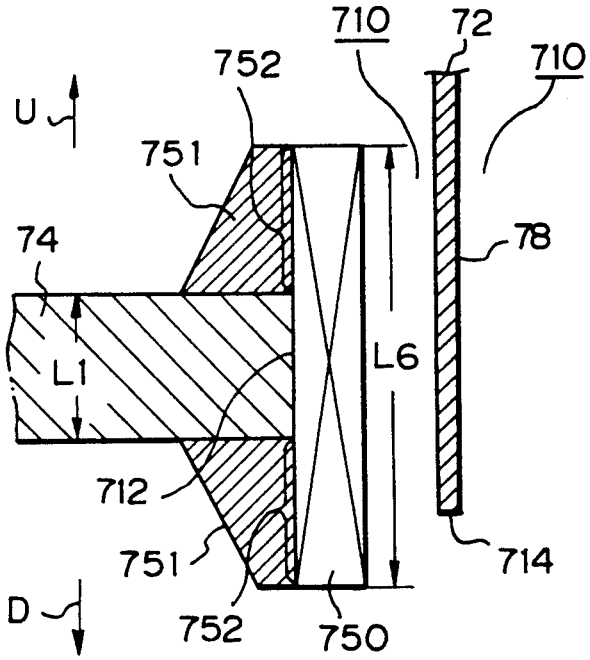
FIG. 29 is a partial enlarged cross sectional view showing modification 3.

FIG. 29 shows an example wherein a heat absorbing material 751 is provided in contact with the back side of a current feeding coil 750 wherein the length in the height direction (that is, the directions indicated by the arrows U-D in FIG. 29) is relatively long.

The heat absorbing material 751 is in contact with the current feeding coil 750, so as to form a ring shape.

By providing such a heat absorbing material 751, the following advantages are derived:

As shown in FIG. 29, in the case where the length of current feeding coil 750 (that is, L6) is formed longer than the cross section of the top plate 74 (that is, the uniform magnetic field range L1), there is no means for effectively dissipating the heat generated in the portion 752 of the current feeding coil 750 which is not in contact with the top plate 74, except by radiation. Therefore, by providing the heat absorbing material 751 in contact with the back side of the portion 752, an effective heat dissipation path is obtained.

To reduce the weight of the diaphragm and improve the sound quality, it is possible to form the whole diaphragm from a conductive polymeric material. Furthermore, it is possible to form only the conductive portion from a material having good conductivity by a predetermined chemical method thereby increasing the selection of materials for the diaphragm. In addition, it is possible to utilize a process for partially thinning the diaphragm, or a process for forming or fixing the conductive portion, or similar processes so as to reduce the weight of the diaphragm as compared with the foregoing embodiments. A construction utilizing these features will now be described with reference to the drawing.

Figure 30:
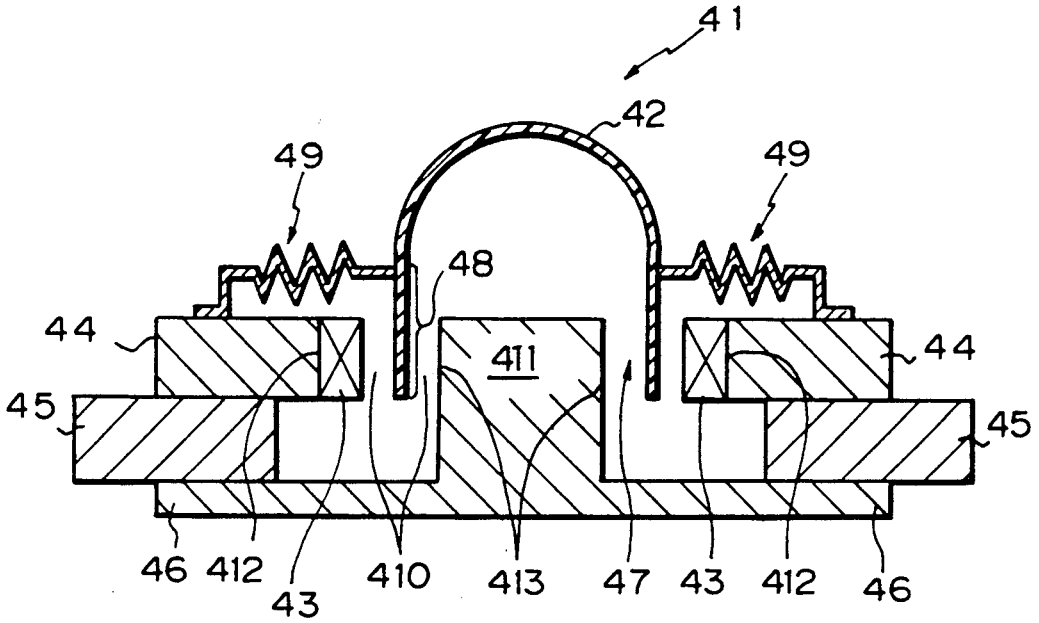
FIG. 30 is a cross sectional view showing the tenth embodiment of the present invention.

The tenth embodiment of the speaker according to the invention is shown in FIG. 30. The speaker 41 shown in FIG. 30, mainly comprises: a diaphragm 42; a damper 49; a current feeding coil 43; a top plate 44; a magnet 45; and a yoke plate 46.

An annular conductive portion 48 is formed in an opening edge portion 47 of the dome-shaped diaphragm 42. The entire diaphragm 42 is made from a polymeric film having a conductive property which is formed by impregnating carbon or metal powder into a polymeric film. For instance, iodine is doped into the base of polyacetylene, thereby providing the conductive property. The diaphragm 42 is supported by the damper 49 so as to vibrate freely in a state wherein the conductive portion 48 is located in a magnetic gap portion 410. The magnetic gap portion 410 is annularly formed between the top plate 44 and a pole piece 411 of the yoke plate 46.

The damper 49 has a spring characteristic and is annularly formed. The inner peripheral side of the damper 49 is connected to the periphery of the conductive portion 48 and the outer peripheral side of the damper 49 is fixed onto the top plate 44.

The attaching position of the current feeding coil 43 and the construction of the magnetic circuit consisting of the top plate 44, magnet 45 and yoke plate 46 are the same as in other embodiments. Since the operation of the speaker 41 is the same as explained in the foregoing embodiments, a detailed description of the operation is ommitted.

Since the diaphragm 42 is made from a relatively light-weight polymeric film which has a relatively large mechanical loss and, no resonance peak occurs within the frequency characteristic response. Therefore, the frequency characteristic response of the speaker 41 is flat. With the resonance peaks eliminated the diaphragm 42 can be easily damped thereby improving the sound quality. Furthermore, since the diaphragm 42 is light weight, the response sensitivity of the speaker 41 is improved. Since the diaphragm 42 is made of a polymeric material, it can be easily molded. Thus, by constructing the diaphragm 42 from a polymeric film having a conductive property, improved frequency response characteristics and sound quality are obtained.

As shown in the diagram, the diaphragm 42 and damper 49 are separately formed and the damper 49 is connected to the conductive portion 48. However, the invention is not limited to this construction. For instance, the damper 49 can be also formed integrally with the conductive portion 48.

By forming a damper integrally with a diaphragm, assembling time is reduced thereby improving assembly efficiency.

Embodiments wherein a damper is formed integrally with a diaphragm will now be described hereinafter with reference to the drawings. It should be noted that when a damper is formed integrally with a diaphragm, either a metal or a polymeric material, which has the conductive property and can be subject to forming, can be used as a material of the diaphragm.

Figure 31:
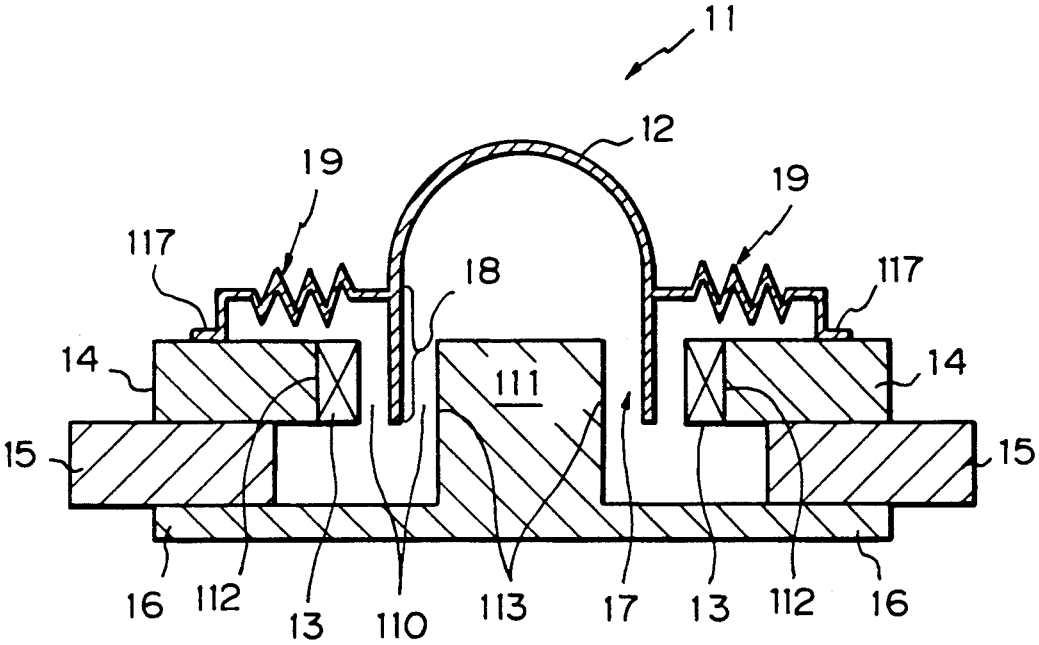
FIG. 31 is a cross sectional view showing the eleventh embodiment of the invention.
Figure 32A:
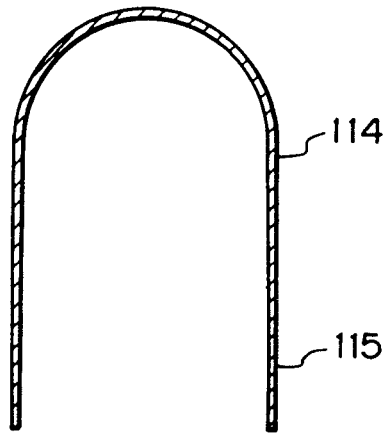
FIG. 32, consisting of A–C, is a cross sectional explanatory diagram showing a method of forming the diaphragm shown in FIG. 31.
Figure 32B:
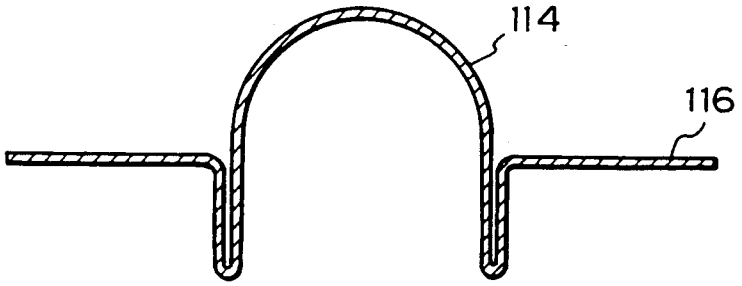
Figure 32C:
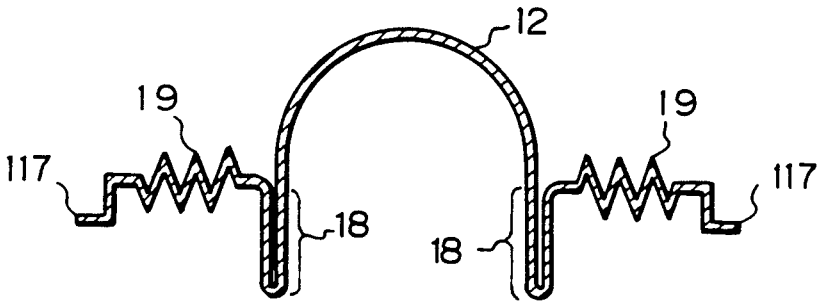

FIGS. 31 and 32 show the eleventh embodiment according to the invention. In the construction shown in FIG. 31, a speaker 11 mainly comprises: a diaphragm 12; a current feeding coil 13; a top plate 14; a magnet 15; and a yoke plate 16.

The dome-shaped diaphragm 12 has at an opening edge portion 17 an annular conductive portion 18 and a damper 19 which is formed integrally with the conductive portion 18. The diaphragm 12 is made from a thin plate shape such as aluminum, beryllium, magnesium, or the like which is a good conductor. The diaphragm 12 is supported by the damper 19 so as to freely vibrate in a state wherein the conductive portion 18 is located in a magnetic gap portion 110. The damper 19 has a spring characteristic and is annularly formed around the conductive portion 18 and is fixed onto the top plate 14. The magnetic gap portion 110 is annularly formed between the top plate 14 and a pole piece 111 of the yoke plate 16.

The current feeding coil 13 electrically couples the annular conductive portion 18, by the mutual inductive operation, and is arranged so as to face the conductive portion 18 with a predetermined gap. The current feeding coil 13 can be arranged so as to face either the outer peripheral corresponding position or inner peripheral corresponding position of the conductive portion 18. The current feeding coil 13 in the example shown in FIG. 31 is fixed to one side edge surface 112 of the top plate 14 so as to face the outer periphery of the annular conductive portion 18. On the other hand, in the case of arranging the current feeding coil 13 at the inner peripheral corresponding position of the conductive portion 18, the coil 13 is fixed to the side of an outer periphery 113 of the pole piece 111. The current feeding coil 13 may be also provided at both the outer and inner peripheral corresponding positions of the conductive portion 18.

The top plate 14, magnet 15, yoke plate 16, and pole piece 111, as shown in FIG. 31, construct a magnetic circuit. That is, the magnet 15 is fixed to the outer peripheral portion of a yoke plate 16. The top plate 14 is fixed to the inner peripheral position of the magnet 15. The magnetic circuit is formed through the magnetic gap portion 110 along a path from the magnet 15 to the top plate 14 and a path from the magnet 15 to the yoke plate 16 and pole piece 111 of the yoke plate 16.

An example illustrating how the diaphragm 12 is formed will now be described with reference to FIG. 32.

First, an opening edge portion 115 of a cylindrical member 114 as shown in FIG. 32A is turned up to form an annular peripheral edge portion 116 as shown in FIG. 32B.

Next, the damber 19 having a spring characteristic is annularly formed in the peripheral edge portion 116. At this time, an annular fixing portion 117 for attachment to the top plate 14 is also formed. Thus, the diaphragm 12 is formed.

The means of forming the diaphragm 12 can be selected from a pressing method or other acceptable means.

The operation of the speaker 11 will now be described.

When an AC current operating as an audio signal flows through the current feeding coil 13, the AC magnetic flux corresponding to the input waveform is generated. Due to the interlinked A.C. magnetic flux, an inductive current with the same frequency is induced in the annular conductive portion 18 by the mutual inductive phenomenon. Since the conductive portion 18 is located in the magnetic gap portion 110, a force proportional to the product of the intensity of the DC magnetic field in the magnetic gap portion 110 and the inductive current, acts on the conductive portion 18. That is, the inductive current in the conductive portion 18 acts on the DC magnetic field in the magnetic gap portion 110, so as to drive the diaphragm 12 thereby generating the sound waves.

The inductive current flows through the conductive portion 18, generating heat due to the resistance component of the conductive portion 18. This time however, the heat is conducted from the conductive portion 18 to the damper 19 which dissipates the heat.

In the high frequency portion of the audio signal, the reciprocating motion of the diaphragm 12 is relatively small. However, since the damper 19 has the spring characteristic, it can trace the reciprocating motion of the diaphragm 12. Furthermore, the diaphragm 12 can be easily attached removed from the top plate 14 through the damper 19 which is integrally formed to the diaphragm 12.

Figure 33A:
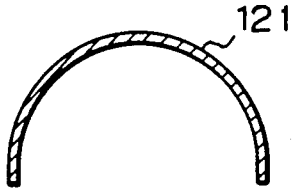
FIG. 33, consisting of A–F, is a cross sectional explanatory diagram corresponding to FIG. 32 and shows the twelfth embodiment of the present invention.
Figure 33B:
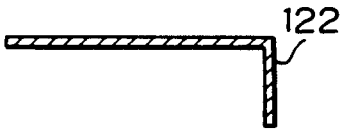
Figure 33C:
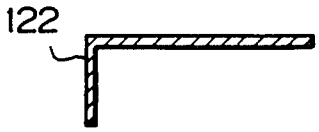

FIG. 33 shows an example of the formation of the diaphragm 120 in the twelfth embodiment wherein, a semi-spherical member 121 is shown in FIG. 33A and an annular plate 122 is shown in FIGS. 33B and 33C,.

Figure 33D:
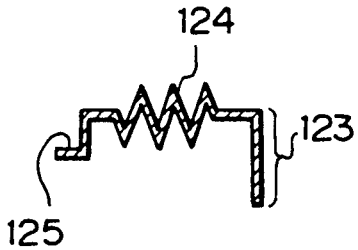
Figure 33E:
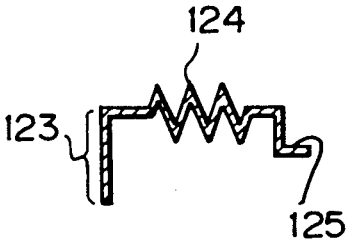

First, as shown in FIGS. 33D and 33E, an annular conductive portion 123, an annular damper 124, and annular fixing portion 125 are formed in plate 122.

Figure 33F:
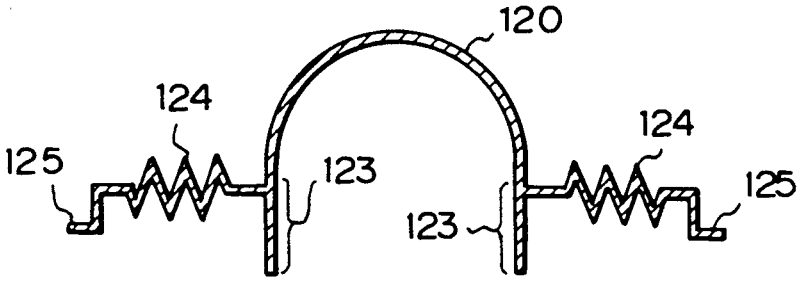

Next, as shown in FIG. 33F, the diaphragm 120 is formed by connecting the semi-spherical member 121 and plate 122.

Since the remaining construction and operation details are similar to those explained in the eleventh embodiment, their overlapped discriptions are omitted.

Figure 34:
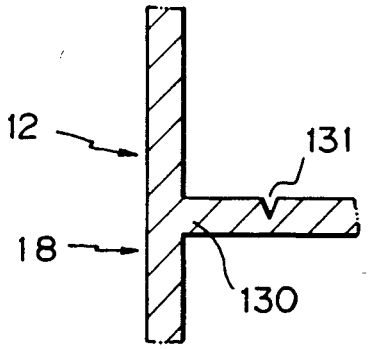
FIG. 34 is a partial enlarged cross sectional view of a modification of the present invention.

FIG. 34 shows an example wherein the flow of inductive current induced in the conductive portion 18 to the damper 19 is limited. As shown in FIG. 34, a notch 131 is annularly formed in a connecting portion 130 between the diaphragm 12 and the damper 19.

Since the area which can conduct current is reduced by the notch 131, the resistance value is relatively increased. Thus, the flow of the inductive current into the damper 19 is blocked thereby increasing the efficiency of the current.

Each of the foregoing embodiments intends to improve the response sensitivity and the frequency characteristic of the speaker by suitably selecting a material for a diaphragam, a shape of a conductive portion, or the like. However, it is also possible to improve the response sensitivity and the frequency characteristic of the speaker by improving a coupling degree of the current feeding coil and conductive portion, or by improving shape of the current feeding coil. Details of construction for these concepts will now be described with reference to the drawings.

Figure 35:
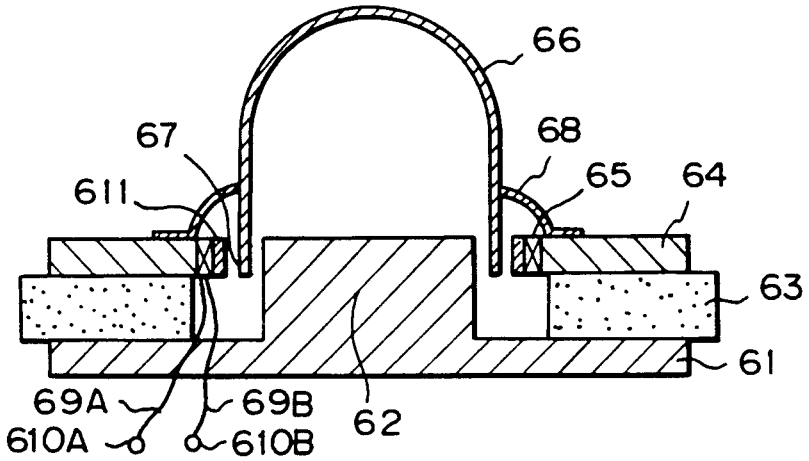
FIG. 35 is a cross sectional view of the thirteenth embodiment of the present invention.

FIG. 35 shows the thirteenth embodiment of the invention. In FIG. 35, a cylindrical pole piece 62 is formed at the center of a disk-shaped yoke plate 61. A ring-shaped magnet 63 is laminated and fixed onto the yoke plate 61. A ring-shaped top plate 64 is laminated and fixed onto the magnet 63. A magnetic circuit is constructed by the yoke plate 61, pole piece 62, magnet 63, and top plate 64. A current feeding coil 65 is wound around the inner periphery of the top plate 64. Lead wires 69A and 69B are led out from the current feeding coil 65. Further, a ring-shaped magnetic material 611 is provided on the inner periphery of the current feeding coil 65. It is also possible to use a member formed by winding a wire in a coil shape for the current feeding coil 65 which is attached to the top plate 64.

A dome-shaped diaphragm 66 is integrally formed from a metal such as aluminum or the like. A conductive portion 67 is formed in the opening edge portion of the diaphragm 66. The conductive portion 67 operates as a voice coil with one turn. It is also possible to form the diaphragm 66 from a non-conductive material such as polymeric film, ceramics, or the like, and to include a conductive material for conductive portion 67 in the respective position.

A magnetic gap is formed in an interval where the outer periphery of the pole piece 62 faces the inner periphery of the top plate 64. The conductive portion 67 formed integrally with the diaphragm 66 is inserted into the magnetic gap. The diaphragm 66 is supported by a damper 68. The damper 68 may be also formed integrally with the diaphragm 66.

The speaker is driven by supplying an audio signal to terminals 610A and 610B of the lead wires 69A and, respectively. That is, an AC signal operating as an audio signal is supplied from the terminals 610A and 610B to the current feeding coil 65 through the lead wires 69A and 69B. A magnetic flux is generated in the current feeding coil 65 by the AC signal. The magnetic flux interlinks the conductive portion 67 which is arranged to face the current feeding coil 65. This causes an induction current to flow through the conductive portion 67. Since the conductive portion 67 is located in the magnetic gap formed in the interval where the outer periphery of the pole piece 62 faces the inner perilphery of the top plate 64, when an induction current flows through the conductive portion 67, a force is generated which moves the conductive portion 67. Therefore, the diaphragm 66, which is integrated with the conductive portion 67, is vibrated due to this force.

Figure 36:
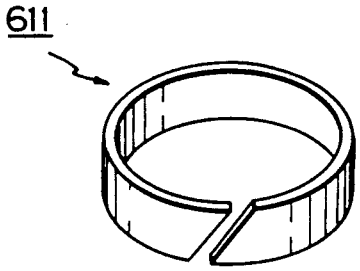
FIGS. 36 and 37 are perspective views of examples of a ring-shaped magnetic material.
Figure 37:
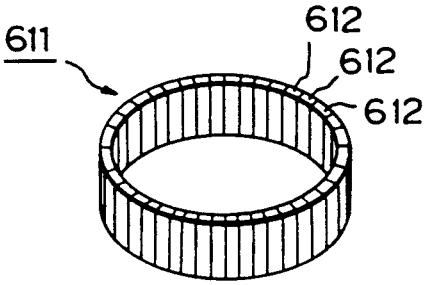

In the thirteenth embodiment, the ring-shaped magnetic material 611, having a high permeability, is provided on the inner periphery of the current feeding coil 65. For the ring-shaped magnetic material 611, as shown in FIG. 36, it is desirable to cut the ring and this is to prevent induction current from flowing in the ring-shaped magnetic material 611. If a magnetic material having a high electric resistance is used as the ring-shaped magnetic material 611, the induction current is consumed. In this case, it is possible to use a material whose both ends are short-circuited together. As shown in FIG. 37, it is also possible to use a material where in a number of magnetic members 612 are laminated together for the ring-shaped magnetic material 611.

In the thirteenth embodiment of the invention, the ring-shaped magnetic material 611 is provided on the inner periphery of the current feeding coil 65. Therefore, the coupling coefficient between the current feeding coil 65 and the conductive portion 67 is increased thereby improving the response sensitivity of the speaker.

Figure 38:
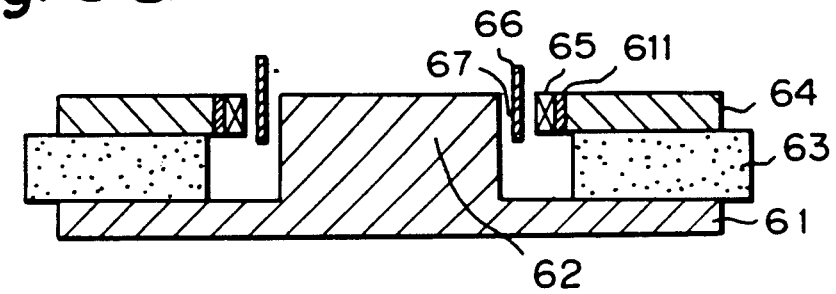
FIGS. 38 to 40 are partial enlarged cross sectional views of modifications of the present invention.
Figure 39:
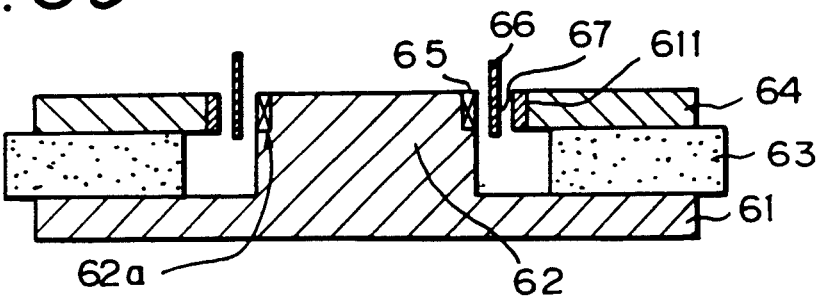

The ring-shaped magnetic material 611 may be arranged at any position so as to raise the coupling coefficient between the current feeding coil 65 and the conductive portion 67. For instance, as shown in FIG. 38, the ring-shaped magnetic material 611 may be also interposed between the outer periphery of the top plate 64 and the inner periphery of the current feeding coil 65. On the other hand, as shown in FIG. 39, it is also possible to wind the current feeding coil 65 around a step portion 62*a* formed on the outer periphery of the pole piece 62 and to arrange the ring-shaped magnetic material 611 to the inner periphery of the top plate 64. Further, as shown in FIG. 40, it is also possible to construct in a manner whereby a current feeding coil 65A is wound around the step portion 62*a* formed on the outer periphery of the pole piece 62, a ring-shaped magnetic material 611A is attached to the outer periphery of the current feeding coil 65A, a current feeding coil 65B is wound around the inner periphery of the top plate 64, and a ring-shaped magnetic material 611B is attached to the inner periphery of the current feeding coil 65B.

Figure 40:
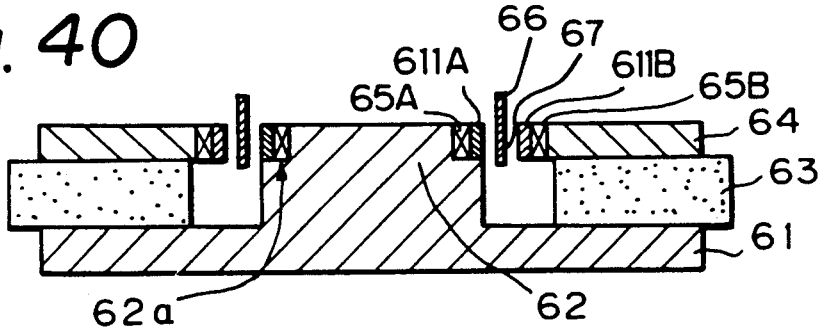

In the construction mentioned above, wherein the step portion 62*a* is formed on the outer periphery of the edge portion of the pole piece 62 and the current feeding coil 65 is wound around the step portion 62*a*, or wherein a member formed by winding a wire in a coil shape is attached to the step portion 62*a* as shown in FIGS. 39 and 40, not only is the current feeding coil 65 held more securely but the heat generated in the current feeding coil 65 is more easily dissipated.

In this manner, by providing the ring-shaped magnetic material 611 to raise the coupling coefficient between the current feeding coil 65 and the conductive portion 67, the response sensitivity of the speaker is improved. In addition, when a ring-shaped magnetic material 611 is attached, the reproducing low frequency limit can be lowered.

Figure 41:
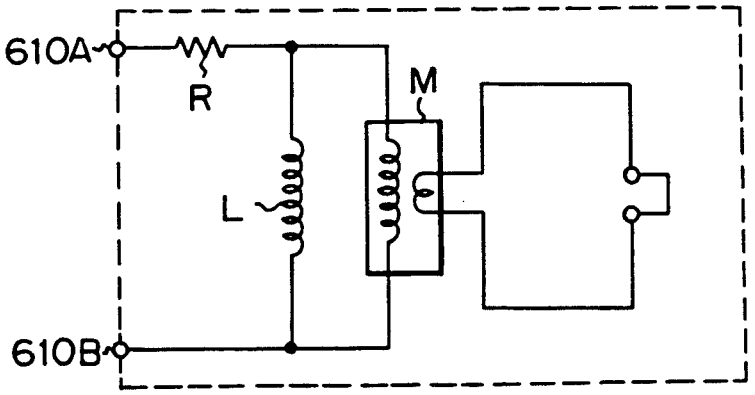
FIG. 41 is an equivalent circuit diagram used for explanation of the thirteenth embodiment of the invention.
Figure 42:
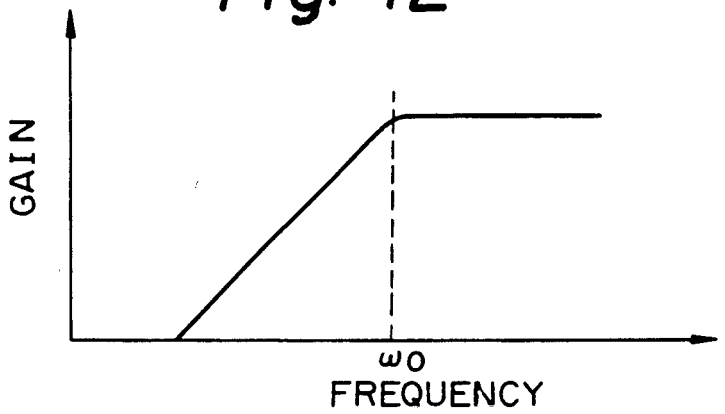
FIG. 42 is a frequency characteristic diagram used to explain the thirteenth embodiment of the invention.

An induction type speaker is shown by an equivalent circuit in FIG. 41. In FIG. 41, R denotes the internal resistance of the current feeding coil 65, L indicates the inductance of the current feeding coil 65, and M is an ideal transformer comprising the current feeding coil 65 and conductive portion 67. As will be understood from FIG. 41, in an input circuit for the induction type speaker, a high-pass filter having a characteristic as shown in FIG. 42 is constructed by the internal resistance R and the inductance L of the current feeding coil 65. The cut-off frequency $\omega_0$ of the high-pass filter is determined by R/L.

As mentioned above, a high-pass filter comprising the internal resistance R and the inductance L of the current feeding coil 65 is formed on the input side of the induction type speaker. The reproducing low frequency limit is caused, in the induction type speaker, by the high-pass filter so that the reproduction of low frequencies cannot be satisfactorily executed.

As mentioned above, the cut-off frequency of the high-pass filter comprising the internal resistance R and the inductance L of the current feeding coil 65 is determined by R/L. Therefore, the cut-off frequency of the high-pass filter can be lowered by reducing the internal resistance R or increasing the inductance L of the current feeding coil 65. However, it is difficult to reduce the internal resistance R of the current feeding coil 65. On the other hand, if the inductance L of the current feeding coil 65 is increased by increasing the number of turns in the current feeding coil 65. The internal resistance R of the current feeding coil 65 is also increased.

According the thirteenth embodiment of the invention, by providing the ringshaped magnetic material 611 on the inner periphery of the current feeding coil 65 the inductance of the current feeding coil 65 rises. Since the cut-off frequency of the high-pass filter comprising the internal resistance R of the current feeding coil 65 and the inductance L of the current feeding coil 65 is determined by R/L, when the inductance of the current feeding coil 65 is increased, the cut-off frequency is lowered whereby the reproducing low frequency limit can be lowered. Thus, the low frequency characteristic can be improved.

Furthermore, by adjusting the inductance L of the current feeding coil 65 with the ring-shaped magnetic material 611, the reproducing low frequency limit of the induction type speaker can be freely set. Thus, in the case of constructing a speaker system, the network circuit can be simplified.

Although the first to thirteenth embodiments have been described with respect to a dome-type speaker, the invention is not limited to it but can be also applied to a cone-type speaker. Furthermore, although the examples shown in the diagrams relate to outer magnet types wherein the magnet is attached to the outer periphery, the invention can be similarly applied to an inner magnet type wherein the magnet is attached to the pole piece.

A speaker system wherein the above-mentioned speaker is applied will now be described.

Figure 43:
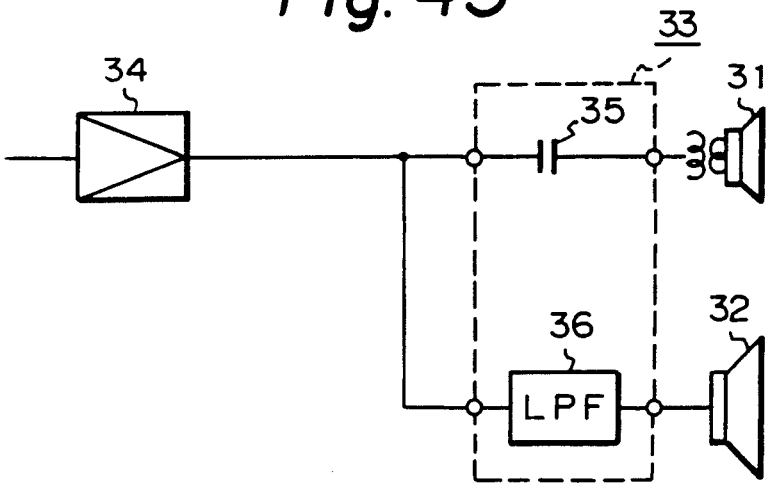
FIG. 43 is a block diagram of an example of a speaker system wherein the present invention is applied.

FIG. 43 shows an example of a speaker system wherein the invention is applied whereby, reference numeral 31 denotes a speaker for a high frequency band and 32 indicates a speaker for a low frequency band. An induction type speaker is used for the high frequency band speaker 31 and a dynamic type speaker is used for the low frequency band speaker 32. An induction type speaker can be also used for the low frequency band speaker 32.

A network 33, comprising a capacitor 35 and a low-pass filter 36, is connected between an output amplifier 34 and speakers 31 and 32. The capacitor 35 is connected to the front stage of speaker 31 and low-pass filter 36 is connected to the front stage of speaker 32. With capacitor 35 connected as mentioned above, this is equivalent to having a high-pass filter, with a slope of 12 dB/oct, connected at the front stage of the speaker 31. This point will now be discussed. The induction type speaker 31 used for the high frequency band and the capacitor 35 are connected. The input side of the induction type speaker 31 comprises an inductance $L_3$ and an internal resistance $R_3$ of the current feeding coil. The signal on the input side is transferred to the secondary side comprising the conductive portion through an ideal trensformer $M_3$.

Figure 44:
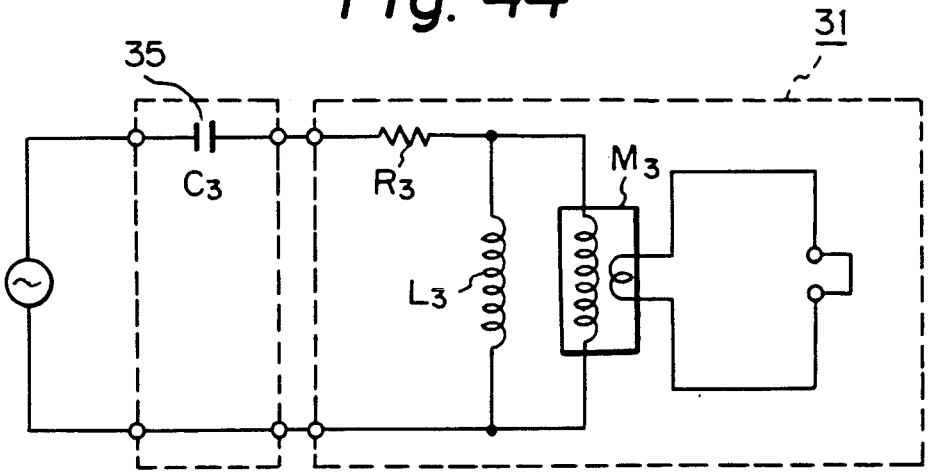
FIG. 44 is an equivalent circuit diagram used for explanation of the speaker system shown in FIG. 43.
Figure 45:
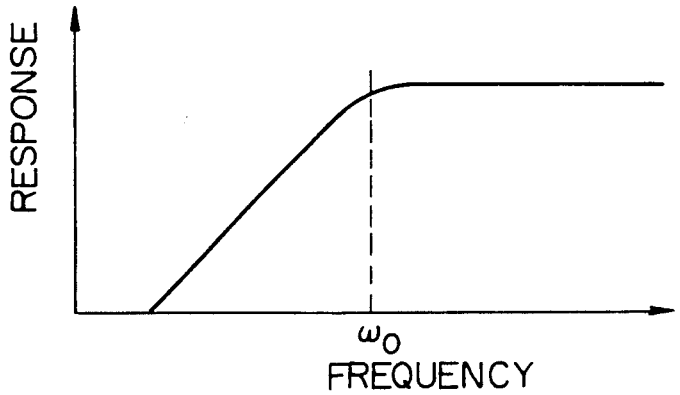
FIGS. 45 and 46 are frequency characteristic diagrams used for explanation of the speaker system shown in FIG. 43.

As shown in FIG. 44, on the input side of the induction type speaker 31, a high-pass filter with a slope of 6 dB/oct, as shown in FIG. 45, is constructed by the inductance L and the internal resistance R of the current feeding coil. The cut-off frequency $\omega_0$ of the high-pass filter is determined by $R_3/L_3$.

Figure 46:
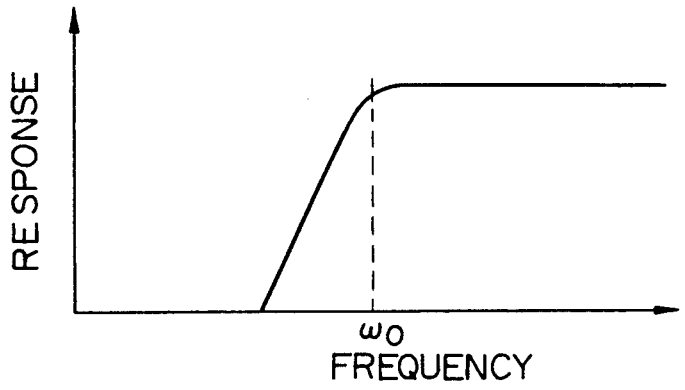

When the capacitor 35 is connected to such an induction type speaker 31, a high-pass filter with a slope of 6 dB/oct is also constructed by the capacitance $C_3$ of the capacitor 35 and the internal resistance $R_3$ of the current feeding coil. Therefore, when the capacitor 35 is connected to the induction type speaker 31 the high pass filter with a slope of 6 dB/oct formed from inductance $L_3$ and internal resistance $R_3$ of the current feeding coil, and the high-pass filter with a slope of 6 dB/oct formed from capacitance $C_3$ of the capacitor 35 and the internal resistance $R_3$ of the current feeding coil are connected. Therefore, by equalizing the cut-off frequencies of both high-pass filters, this is equivalent to having to a high-pass filter with a slope of 12 dB/oct, as shown in FIG. 46, connected at the front stage of the speaker 31.

As mentioned above, when an induction type speaker is used for the high frequency band speaker 31 and is connected to capacitor 35, this is equivalent to inserting a high-pass filter with a slope of 12 dB/oct, thereby, simplifying network circuit 33.

Figure 47:
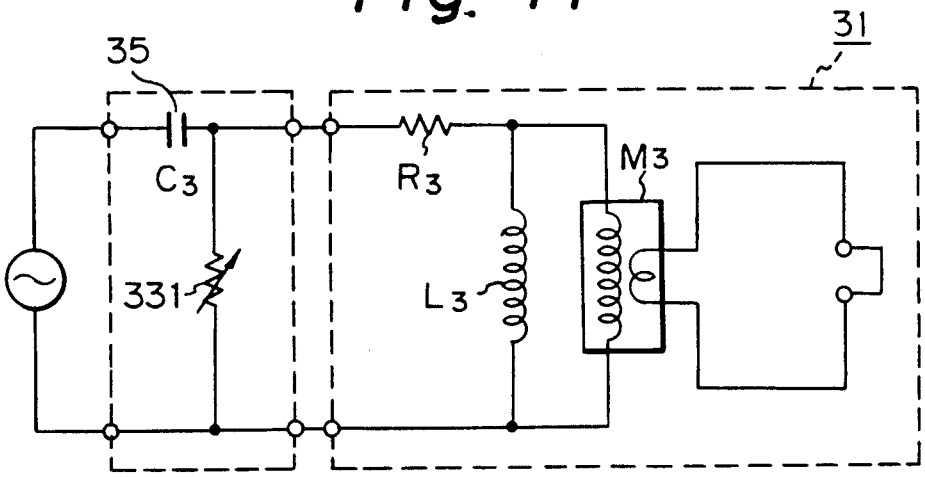
FIG. 47 is an equivalent circuit diagram used for explanation of another example of the present invention.

Even when the induction type speaker is used as a speaker for the middle frequency band, the network circuit can be similary simplified. Additionally, as shown in FIG. 47, a variable resistor 331 may also be connected to adjust the cut-off frequency of the high-pass filter comprising the capacitance $C_3$ of the capacitor 35 and the internal resistance $R_3$ of the current feeding coil.

In the speaker according to the invention, since the diaphragm is formed wherein the electrical resistance of the conductive portion in the diaphragm is lower than the electrical resistance of the vibrating portion, a current will easily flow through the conductive portion. Thus, it becomes difficult for a current to flow through the vibrating portion thereby enabling a larger current to flow through the conductive portion. Therefore, the generation of the leakage current, which is not useful in driving the diaphragm, is prevented. Hence, the induction current is more effectively used. Furthermore, since the generation of the leakage current is prevented, the driving force of the diaphragm can be increased so that the diaphragm can be more sharply driven thereby improving the response sensitivity of the speaker.

Furthermore, the weight of the entire diaphragm can be reduced and the response sensitivity of the speaker can be improved.

Having described specific preferred embodiments of the present invention with reference to the accompanying drawings, it is to be understood that the invention is not limited to those precise embodiments, and that various changes and modifications may be effected therein by one skilled in the art without departing from the scope or the spirit of the invention as defined in the appended claims.

What is claimed is:

1. A speaker comprising:

means defining a magnetic circuit having confronting annular surfaces that are radially spaced apart to form a gap therebetween;

a current feeding coil mounted on one of said annular surfaces and being spaced from the other of said annular surfaces;

a substantially dome-shaped diaphragm having an electrically conductive cylindrical edge portion which is an integral part thereof and which extends axially into said annular gap between said current feeding coil and said other annular surface of the magnetic circuit with clearances therebetween, said cylindrical edge portion of the diaphragm having an electrical resistance substantially lower than an electrical resistance of the remainder of said diaphragm; and means mounting said diaphragm for vibratory movement as a unit relative to said magnetic circuit in directions parallel with a central axis of said cylindrical edge portion of the diaphragm.

2. A speaker according to claim 1; wherein said diaphragm is of a conductive metal and said cylindrical edge portion has a thickness greater than the thickness of said remainder of the diaphragm for providing said substantially lower electrical resistance thereat.

3. A speaker according to claim 2; wherein said greater thickness of said cylindrical edge portion is constituted by an everted margin of said diaphragm.

4. A speaker according to claim 1; wherein said cylindrical edge portion includes an annulus of a material having a better electrical conductivity than said remainder of the diaphragm.

5. A speaker according to claim 4; wherein said annulus is a plated metallic layer.

6. A speaker according to claim 4; wherein said annulus is a conductive metal ring mechanically joined to said remainder of the diaphragm.

7. A speaker according to claim 6; wherein said conductive metal ring is mechanically joined to said remainder of the diaphragm and constitutes the radially outer surface of said cylindrical edge portion, and another conductive metal ring is mechanically joined to said remainder of the diaphragm and constitutes the radially inner surface of said cylindrical edge portion.

8. A speaker according to claim 1; wherein said magnetic circuit provides a DC magnetic field, and said diaphragm has a portion situated outside of said DC magnetic field and having a plurality of holes therein.

9. A speaker according to claim 1; wherein said diaphragm includes a non-conductive hollow body coextensive with both said cylindrical edge portion and said remainder of the diaphragm, and an electrically conductive annulus joined to said body and being coextensive with said cylindrical edge portion of the diaphragm.

10. A speaker according to claim 9; wherein said electrically conductive annulus is a metal ring joined to an outer surface of said body.

11. A speaker according to claim 9; wherein said electrically conductive annulus is a metal ring joined to an inner surface of said body.

12. A speaker according to claim 9; wherein said electrically conductive annulus has a U-shaped cross-section which receives a free-edge portion of said hollow body and is joined to the latter at inner and outer surfaces thereof.

13. A speaker according to claim 1; wherein said diaphragm is formed of an electrically non-conductive material which, in the region of said cylindrical edge portion, is impregnated with an electrically conductive material.

14. A speaker according to claim 1; wherein one of said current feeding coil and said cylindrical edge portion of the diaphragm has a dimension in said directions of vibratory movement greater than a dimension of the other of said current feeding coil and said cylindrical edge portion in said directions so that, during said vibratory movements, AC coupling of said current feeding coil and said cylindrical edge portion remains constant.

15. A speaker according to claim 14; wherein said dimension of the cylindrical edge portion is larger than said dimension of the current feeding coil.

16. A speaker according to claim 14; wherein said dimension of the current feeding coil is larger than said dimension of the cylindrical edge portion of said diaphragm and also larger than the corresponding dimension of said one annular surface on which said current feeding coil is mounted; and further comprising heat absorbing means connecting said magnetic circuit with portions of said current feeding coil which extend beyond said one annular surface.

17. A speaker according to claim 1; wherein said means mounting the diaphragm includes a damper member integral with said electrically conductive cylindrical edge portion and extending to said magnetic circuit, and said damper member has means therein for restricting current flow therethrough from said electrically conductive cylindrical edge portion.

18. A speaker according to claim 17; wherein said means for restricting current flow through said damper member includes a cross-sectional region thereof having a reduced thickness.

19. A speaker according to claim 1; further comprising means interposed in said gap for enhancing a coupling coefficient of said current feeding coil in respect to said cylindrical edge portion of the diaphragm.

20. A speaker according to claim 19; wherein said means for enhancing the coupling coefficient includes a member having a relatively high magnetic permeability and which is attached to a surface of said current feeding coil facing said cylindrical edge portion of the diaphragm.

21. A speaker according to claim 19; wherein said means for enhancing the coupling coefficient includes a member having a relatively high magnetic permeability and which is interposed between said current feeding coil and said one annular surface of the magnetic circuit.

22. A speaker according to claim 19; wherein said means for enhancing the coupling coefficient includes an annular member having a relatively high magnetic permeability and being interrupted by at least one slit for preventing a flow of induction current therein.

23. A speaker comprising:

means defining a magnetic circuit having confronting annular surfaces that are radially spaced apart to form a gap therebetween;

a current feeding coil mounted on one of said annular surfaces and being spaced from the other of said annular surfaces;

a substantially dome-shaped diaphragm having an electrically conductive cylindrical edge portion which is an integral part thereof and which extends axially into said annular gap between said current feeding coil and said other annular surface of the magnetic circuit with clearances therebetween; and means mounting said diaphragm for vibratory movement as a unit relative to said magnetic circuit in directions parallel with a central axis of said cylindrical edge portion of the diaphragm, and including a damper member integral with said electrically conductive cylindrical edge portion and extending to said magnetic circuit, and means in said damper member for restricting current flow therethrough from said electrically conductive cylindrical edge portion.

24. A speaker according to claim 23; wherein said means for restricting current flow through said damper member includes a cross-sectional region thereof having a reduced thickness.

25. A speaker comprising:

means defining a magnetic circuit having confronting annular surfaces that are radially spaced apart to form a gap therebetween;

a current feeding coil mounted on one of said annular surfaces and being spaced from the other of said annular surfaces;

a substantially dome-shaped diaphragm having an electrically conductive cylindrical edge portion which is an integral part thereof and which extends axially into said annular gap between said current feeding coil and said other annular surface of the magnetic circuit with clearances therebetween, said cylindrical edge portion of the diaphragm having an electrical resistance substantially lower than an electrical resistance of the remainder of said diaphragm;

means mounting said diaphragm for vibratory movement as a unit relative to said magnetic circuit in directions parallel with a central axis of said cylindrical edge portion of the diaphragm; and a viscous magnetic fluid filling said clearances for increasing magnetic flux density in said gap, transferring heat generated in said conductive cylindrical edge portion to said magnetic circuit and controlling a resonant characteristic of said vibratory movement.

26. A speaker comprising:

means defining a magnetic circuit having confronting annular surfaces that are radially spaced apart to form a gap therebetween;

a current feeding coil mounted within said gap on one of said annular surfaces and being spaced from the other of said annular surfaces, said coil consisting of flat wire having a substantially rectangular cross-section with a relatively large dimension thereof extending in a direction across said gap and corresponding to the thickness of said coil in said direction, and with said flat wire being helically wound to provide successive turns of said coil which contact each other over the entire extent of said relatively large dimension for improving heat transmission within said coil and dissipation of the heat therefrom, and for optimizing the mass of said coil that can be accommodated within said gap;

a substantially dome-shaped diaphragm having an electrically conductive cylindrical edge portion which is an integral part thereof and which extends axially into said annular gap between said current feeding coil and said other annular surface of the magnetic circuit with clearances therebetween, said cylindrical edge portion of the diaphragm having an electrical resistance substantially lower than an electrical resistance of the remainder of said diaphragm; and means mounting said diaphragm for vibratory movement as a unit relative to said magnetic circuit in directions parallel with a central axis of said cylindrical edge portion of the diaphragm.

* * * * *